US006652056B2

(12) United States Patent
Shioya

(10) Patent No.: US 6,652,056 B2
(45) Date of Patent: Nov. 25, 2003

(54) INK-JET RECORDING APPARATUS AND RECORDING METHOD

(75) Inventor: Makoto Shioya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/731,750

(22) Filed: Dec. 8, 2000

(65) Prior Publication Data

US 2001/0003458 A1 Jun. 14, 2001

(30) Foreign Application Priority Data

Dec. 13, 1999 (JP) ..... 11-352858

(51) Int. Cl.[7] ..... B41J 29/38
(52) U.S. Cl. ..... 347/12; 347/14; 347/19
(58) Field of Search ..... 347/19, 23, 14, 347/7, 12; 358/1.9, 502, 504

(56) References Cited

U.S. PATENT DOCUMENTS

| | | | | | |
|---|---|---|---|---|---|
| 4,313,124 | A | | 1/1982 | Hara | 347/57 |
| 4,328,504 | A | | 5/1982 | Weber et al. | 347/14 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,558,333 | A | | 12/1985 | Sugitani et al. | 347/65 |
| 4,608,577 | A | | 8/1986 | Hori | 347/66 |
| 4,723,129 | A | | 2/1988 | Endo et al. | 347/56 |
| 4,740,796 | A | | 4/1988 | Endo et al. | 347/56 |
| 4,907,013 | A | * | 3/1990 | Hubbard et al. | 347/19 |
| 4,963,882 | A | * | 10/1990 | Hickman | 347/19 |
| 4,977,459 | A | * | 12/1990 | Ebinuma et al. | 347/19 |
| 5,124,720 | A | * | 6/1992 | Schantz | 347/19 |
| 5,140,429 | A | | 8/1992 | Ebinuma et al. | 347/19 |
| 5,296,876 | A | * | 3/1994 | Yamaguchi et al. | 347/23 |
| 5,434,605 | A | * | 7/1995 | Osborne | 347/23 |
| 5,627,571 | A | * | 5/1997 | Anderson et al. | 347/19 |
| 5,798,771 | A | * | 8/1998 | Nishii et al. | 347/7 |
| 5,798,773 | A | * | 8/1998 | Hiramatsu et al. | 347/19 |
| 6,238,034 | B1 | * | 5/2001 | Ono | 347/19 |
| 6,278,469 | B1 | * | 8/2001 | Bland et al. | 347/19 |
| 6,332,662 | B1 | * | 12/2001 | Choi | 347/19 |

FOREIGN PATENT DOCUMENTS

| | | |
|---|---|---|
| EP | 0 570 167 | 11/1993 |
| EP | 0 694 396 | 1/1996 |
| JP | 54-56847 | 5/1979 |
| JP | 57-41965 | 3/1982 |
| JP | 59-123670 | 7/1984 |
| JP | 59-138461 | 8/1984 |
| JP | 60-71260 | 4/1985 |
| JP | 2708439 | 10/1997 |
| JP | 2711011 | 10/1997 |

OTHER PUBLICATIONS

Frank Cost, Pocket Guide to Digital Printing, 1997, Delmar Publishers, pp. 98–100.*

* cited by examiner

*Primary Examiner*—Stephen D. Meier
*Assistant Examiner*—Blaise Mouttet
(74) *Attorney, Agent, or Firm*—Fitzpatrick, Cella, Harper & Scinto

(57) ABSTRACT

It is an object to provide an ink-jet recording apparatus capable of always obtaining an image having a high quality without difficulty for a user by precisely detecting a cause which deteriorates image quality and by efficiently resolving the cause. The cause of the deterioration in image quality is detected on the basis of a difference S between image data G intended to be recorded and read data Y which is obtained by reading the image that is recorded on a recording medium (S=G−Y), thereby determining a processing method for resolving the cause. The determined processing method is executed and, thus, normal recording is always possible.

33 Claims, 15 Drawing Sheets

INK-JET RECORDING APPARATUS AND RECORDING METHOD

BACKGROUND OF THE INVENTION

1. Field of the Invention

The present invention relates to an ink-jet recording apparatus in which an image with a high quality image can always be formed. The invention can be applied to all equipment that uses recording media such as a sheet, a cloth, a non-woven fabric, or an OHP sheet, e.g., business equipment and mass-production equipment such as a printer, copying machine, or facsimile apparatus.

2. Description of the Related Art

In association with the widespread use of information processing equipment such as a copying machine, a word processor, and a computer and, further, of communication equipment, an ink-jet recording apparatus for recording a digital image by an ink-jet method has rapidly spread as one type of output apparatus for forming (recording) images processed by the information processing equipment or the communication equipment.

A conventional ink-jet recording apparatus comprises a recording head (hereinlater, referred to as a multi-head) which is formed by aligning a plurality of ink discharge nozzles. The nozzles of the recording head discharge ink, and the ink adheres to a recording medium, thereby forming an image. Generally, the ink-jet recording apparatus comprises a plurality of the multi-heads corresponding to colors for the purpose of recording a color image. The conventional ink-jet recording apparatus having the recording heads has excellent characteristics that enables an image with higher quality to be formed or recorded at a higher speed, more quietly, and more inexpensively, as compared with that in accordance with other recording methods.

However, the conventional ink-jet recording apparatus has various problems as described in the following paragraphs numbered (1) to (6).

(1) In the step of producing the recording head, slight differences in the shape of a discharge port of the recording head and in the performance of an electricity-to-heat converter (discharge heater) are produced and, thus, the discharge amounts and the discharging directions of the ink which is discharged from the discharge port are varied. There is a problem (first problem) that unevenness of density occurs in an image and an image quality deteriorates when the discharge amounts and the discharging directions of the ink vary, as mentioned above. A specific example will be described with reference to FIGS. 15A to 15C and FIGS. 16A to 16C. Referring to FIG. 15A, reference numeral 91 denotes a multi-head which comprises eight multi-nozzles 92. Reference numeral 93 denotes ink droplets which are discharged by the multi-nozzles 92 and, ideally, an equal amount of discharged ink should be discharged in the indicated direction as shown in the figure. If the ink is discharged in the aforementioned manner, dots having the same size are shot on a sheet (as shown in FIG. 15B) and an even image having no unevenness of density as a whole can be obtained (as shown in FIG. 15C). However, the discharge amounts and the discharging directions are actually varied depending on the nozzles, so that if printing is executed in the manner similar to the foregoing, the size and the direction of ink droplets which are discharged from the nozzles are varied as shown in FIG. 16A, and dots are shot on a sheet as shown in FIG. 16B. Referring to FIGS. 16A and 16B, there is a blank portion which cyclically satisfies no area factor of 100%, on the contrary, dots are overlapped more than required, and a white streak is caused at the center. The dots which are shot in the above-described state produces a density distribution for the nozzle and the discharged direction shown in FIG. 16C. Consequently, the phenomenon is usually detected as unevenness of density from the eyes of a human.

(2) The amount of discharged ink from one discharge port changes as a function of time, so that there is problem that the unevenness of density occurs in an image and, an image having a proper density cannot be recorded (second problem). Specifically speaking, when an image is scanned in the main scanning direction by the recording head and the image is recorded, energy for driving the discharge accumulates over time and the temperature of the head rises. In accordance therewith, the viscosity of ink decreases and the amount of discharged ink increases. In particular, according to an ink-jet method known as the (hereinafter, bubble jet method, abbreviated to the BJ method) for forming a flying fluid droplet by use of thermal energy and for recording an image, a foaming force increases due to the increase in temperature of the ink and the amount of discharged ink increases remarkably. Consequently, in general, the density of the image is higher on the side of the end of recording in the main scan than that on the side of the start thereof. Although the phenomenon causes a problem for the typical image, a low-density portion at the start of writing may come into contact with a high-density portion at the end of writing, especially in the case of reciprocating recording and thus, the density difference becomes more remarkable. In accordance with the increase in the number of discharge times, a burnt deposit on the heater unit according to the BJ method causes the amount of discharged ink to decrease.

(3) The amount of discharged ink from a discharge port changes because of dirt near the discharge port which is caused by ink mist and sheet powder or dust, the mixture of bubbles and dust within the discharge port, and the thickening by evaporation of an ink solvent, etc. This causes a problem that an image having a proper density cannot be recorded (third problem).

(4) When the phenomenon noted in paragraph (3) occurs is remarkable, that is, the discharge port is clogged and a non-discharge nozzle is caused, there is a problem that a clear white streak appears in the image and the quality of the image degrades. When the appearance of burnt deposit ("koga") is remarkable according to the BJ recording method, the discharge also becomes defective and the amount of discharged ink excessively decreases, thereby causing the occurrence of the white streak (fourth problem).

(5) There is a possibility of a stoppage of discharge (non-discharge) which is caused by a short circuit due to corrosion, etc. of a power supply line to the nozzles or by a short circuit of a discharge heater in the recording head according to the BJ method. This causes a problem that a clear white streak appears due to the non-discharge and the quality of the image degrades (fifth problem).

(6) If a large part of ink in the ink tank is consumed and there is a small amount of ink remaining in the ink tank, this causes a problem that a patchy portion appears in the whole image and the quality of the image deteriorates (sixth problem).

Conventional ink-jet recording systems cope with the problems (1) to (6) as follows.

Against problem (1), there are methods for recording a test pattern cyclically/non-cyclically, reading it, determining a state of the recording head, and adjusting a method of image processing as disclosed in Japanese Patent Laid-Open No. 57-41965, Japanese Patent Publication No. 2708439, and Japanese Patent Publication No. 2711011. These methods are used when a user sees an image which is usually recorded and determines that the image is degraded. If specific handling which is different from the usual use such as exchanging of the head or exchanging of an ink tank, is required, the adjustment is executed. As mentioned above, all of the nozzles are adjusted so as to eliminate the variations of the amount of discharged ink and the discharging direction of the discharge ports.

Against problems (2) and (3), there is a method for cyclically/non-cyclically wiping and cleaning the discharge ports. The method is performed when a user judges that the image is degraded, the head is exchanged, the ink tank is exchanged, or the head is unused for a predetermined time period. As described above, against problems (2) and (3), all of the nozzles are subjected to recovering processes such as wiping and cleaning so as to properly discharge ink, thereby coping with the change in amount of discharged ink from one discharge port over time and thickening of the ink.

When the discharge of ink stops as in problems (4) and (5), the user visually finds it and copes therewith. In other words, the user judges that the image deteriorates and determines that the exchanging of the head is required.

Against problem (6), there is a method for automatically detecting the remaining ink and notifying the user of the detected result via a host computer, etc., as well as the method for visually judging the image by the user. In this manner, the user can know that the ink supply should be replenished in the ink tank.

Although conventionally, the countermeasures are performed against problems (1) to (6) by the above-described methods, the user must judge the state of the recorded image according to the conventional methods and thus, these methods are troublesome for the user. Currently, a high speed and a large capacity are required for the ink-jet recording apparatuses as office-automation equipment. If the problems (1) to (6) arise, the above-described methods not only are troublesome for the user but also take a long time because the user must determine which the coping method to employ, thus reducing the recording speed. According to the methods, the user must always monitor the recorded image and this imposes a burden upon the user. Particularly, as the amount of recording data increases, the burden increases.

Continuity of operation and high availability are requirements for an ink-jet recording apparatus for industrial applications, e.g., textile and printing. If the head is exchanged with every occurrence of the non-discharge nozzle, the apparatus must be stopped with every exchange of the head and thus, not only the availability of the system decreases, but also the throughput decreases.

In view of the problems associated with these coping methods, a method disclosed in Japanese Patent Publication No. 3-33508 (U.S. Pat. No. 4,328,504) is considered. Japanese Patent Publication No. 3-33508 discloses that a recorded image is read by optical reading means, a nozzle is cleaned when it is detected that no ink dot exists at the place to which the image ought to be recorded, the size of ink dot to be recorded is not correct, and the condition of driving discharge-operation and a scanning speed of the head, etc., are changed if it is detected that the place to which the ink dot is recorded is not correct.

Although, according to the method disclosed in Japanese Patent Publication No. 3-33508, the nozzle is cleaned when the first discharge defect is detected, in other words, it is detected that no ink dot exists at the place to which the ink dot ought be recorded, it is useless to clean the nozzle if the absence of ink in the ink tank causes the first discharge defect. That is, because, even if the nozzle is cleaned, dischargeable ink is not available and the first discharge defect is not solved. In the case of causing the first discharge defect occurring due to a short circuit of the discharge heater, again it cannot be solved by cleaning the nozzle. According to the method disclosed in Japanese Patent Publication No. 3-33508, the useless operation is executed and this wastes time and the throughput further decreases. If the first discharge defect is not solved by cleaning the nozzle and the recording is continued by using the head, a white streak may occur in the image. The apparatus must be halted when exchanging the head, thereby resulting in a decrease in recording speed.

According to the method disclosed in Japanese Patent Publication No. 3-33508, when the second discharge defect is detected, in other words, it is detected that the position at which the ink dot is recorded is not correct, the scanning speed of the head and the discharging speed of the ink are changed. However, it is difficult to ensure the variation in sub-scanning directions of the discharge are corrected by adjusting the two above-mentioned speeds. Also, changing of the two speeds on every detection of a second discharge defect complicates the control operation.

Further, according to the method disclosed in Japanese Patent Publication No. 3-33508, when the third discharge defect is detected, that is, it is detected that the size of the ink dot to be recorded is not correct, a driving condition of the nozzle for discharging ink is changed. However, if the extent of the discharge defect is large, it is insufficient merely to change the driving condition, with the result that the recording is executed in a state in which the correction is insufficient, thus reducing the quality of the image.

Accordingly, as described above, if the method disclosed in Japanese Patent Publication No. 3-33508 is employed, it is impossible to judge precisely an abnormal cause to avoid the waste of time, and to obtain a high quality image having evenness of density.

SUMMARY OF THE INVENTION

In order to solve these problems, one object of the present invention is to provide an ink-jet recording apparatus and a recording method capable of precisely determining the cause of deterioration in the quality of image and efficiently overcoming the cause.

Another object of the present invention is to provide an ink-jet recording apparatus and a recording method capable of preventing the decrease in throughput as much as possible and recording an image with a high quality without troubling the user when the discharge defect is caused.

In order to accomplish the objects, according to a first aspect of the present invention, an ink-jet recording apparatus for recording an image by scanning a head having a plurality of ink discharge nozzles and recording the image to a recording medium includes a reading unit for reading the recorded image which is recorded to the recording medium, and a discriminating unit for discriminating whether there is a discharge-defective nozzle or not by detecting a difference of density information between read density-information which is read by the reading unit and image density information to be inherently recorded, wherein when the discriminating unit determines that there is the discharge-defective nozzle, a processing method to be executed is determined from a plurality of processing methods to prevent the deterioration in image due to the discharge-defective nozzle in accordance with a fact that the difference between both the density information is equal to a predetermined value or more.

According to a second aspect of the present invention, an ink-jet recording system for recording an image by a scanning a head having a plurality of ink discharge nozzles to a recording medium includes a reading unit for reading the recorded image which is recorded to the recording medium, a first discriminating unit for discriminating whether there is a discharge-defective nozzle or not by detecting a difference of density information between read density-information which is read by the reading unit and image density information to be inherently recorded every nozzle, a second discriminating unit for discriminating whether the difference between both the density information is equal or more to a predetermined value, or less, and a third discriminating unit for discriminating the number of nozzles in which the difference between both the density information occurs, wherein when the first discriminating unit determines that there is the discharge-defective nozzle, on the basis of the determined result by the second discriminating unit and the third discriminating unit, a processing method to be executed is determined from a plurality of processing methods to prevent the deterioration in image due to the discharge-defective nozzle.

According to a third aspect of the present invention, an ink-jet recording system for recording an image by the scanning a head having a plurality of ink discharge nozzles and recording the image to a recording medium includes a discriminating unit for discriminating whether there is a discharge-defective nozzle every nozzle or not, wherein when the discriminating unit determines that there is the discharge-defective nozzle, a processing method to be executed is determined from a plurality of processing methods to prevent the deterioration in image due to the discharge-defective nozzle in accordance with an information difference between information which is indicated by a normal nozzle and information which is indicated by the discharge-defective nozzle.

According to a fourth aspect of the present invention, an ink-jet recording method for recording an image by scanning a head having a plurality of ink discharge nozzles and recording the image to a recording medium includes a reading step of reading the recorded image which is recorded to the recording medium, a discriminating step of discriminating whether or not there is a discharge-defective nozzle by detecting a difference of density information between read density-information which is read in the reading step and image density information to be inherently recorded, and a determining step of, when it is determined in the discriminating step that there is the discharge-defective nozzle, determining a processing method to be executed from a plurality of processing methods to prevent the deterioration in image due to the discharge-defective nozzle in accordance with a fact that the difference between both the density information is equal to a predetermined value or more.

According to a fifth aspect of the present invention, an ink-jet recording method for recording an image by scanning a head having a plurality of ink discharge nozzles and recording the image to a recording medium includes a reading step of reading the recorded image which is recorded in the recording medium, a first discriminating step of discriminating whether or not there is a discharge-defective nozzle by detecting a difference of density information between read density-information which is read in the reading step and image density information to be inherently recorded, a second discriminating step of discriminating whether or not the difference between both the density information is equal to a predetermined value or more, a third discriminating step of discriminating the number of nozzles in which the difference between both the density information occurs, and a determining step of, when it is determined in the first discriminating step that there is the discharge-defective nozzle, determining a processing method to be executed from a plurality of processing methods to prevent the deterioration in image due to the discharge-defective nozzle, on the basis of the determined result in the second discriminating step and the third discriminating step.

According to a sixth aspect of the present invention, an ink-jet recording method for recording an image by scanning a head having a plurality of ink discharge nozzles and recording the image to a recording medium includes a discriminating step of discriminating whether or not there is a discharge-defective nozzle every nozzle, and a determining step of, when it is determined in the discriminating step that there is the discharge-defective nozzle, determining a processing method to be executed from a plurality of processing methods to prevent the deterioration in image due to the discharge-defective nozzle in accordance with an information difference between information which is indicated by a normal nozzle and information which is indicated by the discharge-defective nozzle.

Further objects, features and advantages of the present invention will become apparent from the following description of the preferred embodiments with reference to the attached drawings.

DESCRIPTION OF THE PREFERRED EMBODIMENTS

Embodiments of the present invention will be described hereinafter with reference to the drawings.

[First Embodiment]

Figure 1:
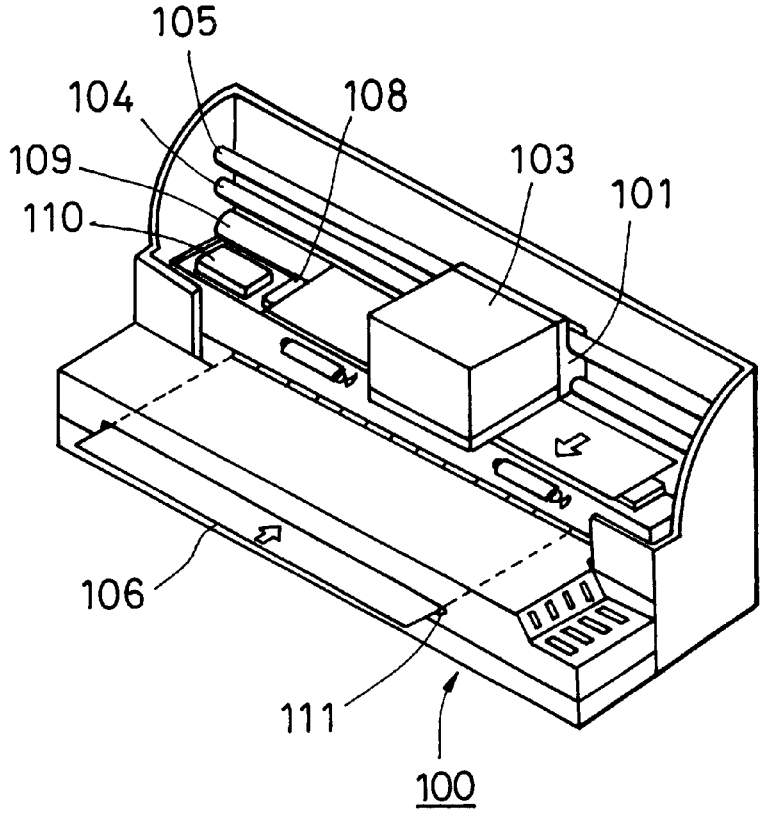
FIG. 1 is a perspective view showing an outline of an ink-jet recording apparatus according to a first embodiment of the present invention.

FIG. 1 is a perspective view showing an outline of an ink-jet recording apparatus according to a first embodiment of the present invention. In an ink-jet recording apparatus 100, a carriage 101 slidably engages with two guide shafts 104 and 105 which mutually extend in parallel. Thus, the carriage 101 can move along the guide shafts 104 and 105 by a drive-force transmitting mechanism such as a motor for driving and a belt for transmitting a drive force of the motor (not shown). An ink-jet head unit 103 is provided on the carriage 101.

Figure 2:
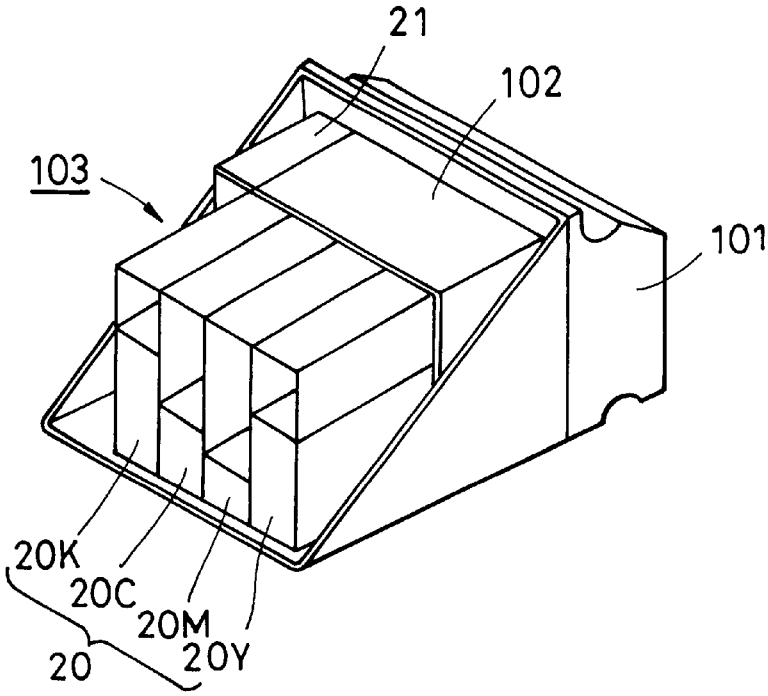
FIG. 2 is a schematic perspective view showing the ink-jet head unit 103 in FIG. 1.

As shown in FIG. 2, the ink-jet head unit 103 comprises heads (ink discharging units) 102 for discharging ejecting ink, a reading unit 21 for reading a state of a recorded image which is recorded on a recording medium, and an ink tank 20 which accommodates the ink which is supplied to the heads 102. The four heads 102 having discharging units for discharging four-color ink of black (K or Bk), cyan (C), magenta (M), and yellow (Y), and an optical reading unit 21 having a plurality of reading elements, and the ink tank 20 which is provide on the heads 102 are provided on the carriage 101 as the ink-jet head unit 103.

A recording medium 106 such as a sheet, a cloth, a non-woven fabric, or an OHP sheet is inserted through an inserting port 111 which is provided at the front end of the apparatus, a conveying direction thereof is finally reversed, and a feed roller 109 conveys the recording medium 106 through an area above which the carriage 101 moves. Consequently, the image is printed in a printing area on the medium 106, which is supported by a platen 108, by the heads 102, which are provided on the carriage 101 in accordance with the movement of the heads 102.

A recovering system unit 110 which can face the heads 102 (ink discharging units) on the carriage 101 from below is provided at the left end of the area in which the carriage 101 can move. Thus, it is possible to implement an operation for capping the discharge ports of the heads 102 and operations such as absorption of ink from the discharge ports of the heads 102 during non-recording, etc. The position which faces the recovering system unit 110 is called as a home position of the heads.

FIG. 2 is a schematic perspective view showing the ink-jet head unit 103 which has been described in FIG. 1. The ink-jet head unit 103 comprises the head 102, the optical reading unit 21, and the ink tank 20. The heads 102 comprising discharge units 30K, 30C, 30M, and 30Y (not shown) having a plurality of ink discharge nozzles for discharging the Bk-, C-, M-, and Y- inks, the optical reading unit 21, and the ink tank 20 comprising a tank 20K for Bk, a tank 20C for C, a tank 20M for M, and a tank 20Y for Y are provided on the carriage 101. The ink tanks are connected to the heads 102 via a connecting portion, and the ink is supplied these through.

Figure 6:
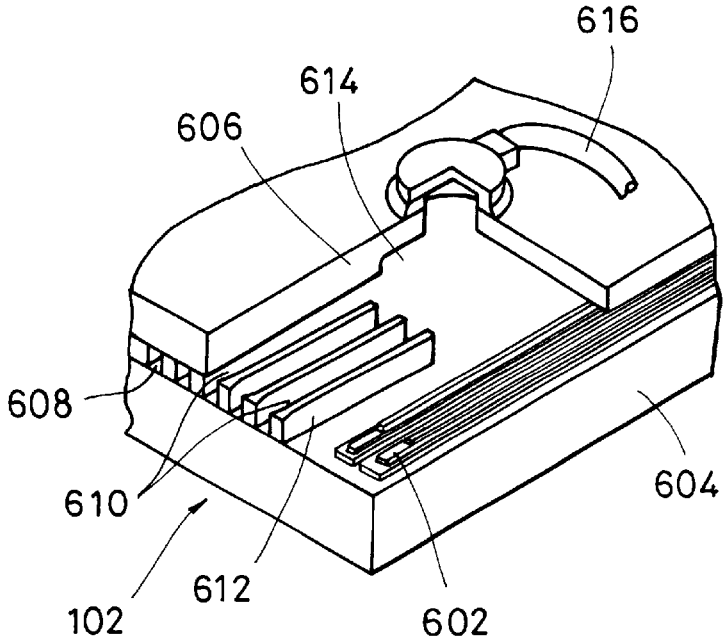
FIG. 6 is a diagram showing a structure of an ink-jet head 102 which is used with the ink-jet recording apparatus 100 in FIG. 1.

FIG. 6 is a diagram showing a structure of the ink-jet head 102 which is used with the ink-jet recording apparatus 100 in FIG. 1. Although the four ink-jet heads are provided so as to correspond to the four colors of Bk, C, M, and Y, FIG. 6 shows one structure thereof which is typical because the four heads have the same structure.

Referring to FIG. 6, the ink-jet head 102 schematically comprises a heater board 604 which is a board on which a plurality of heaters 602 for heating ink are formed and a top board 606 which covers the heater board 604. A plurality of discharge ports 608 are formed to the top plate 606 and fluid passages 610 which are tunnel-shaped and communicate through the discharge ports 608 are formed at the backside of the discharge ports 608. The fluid passages 610 are partitioned from the adjacent fluid passages by respective partitions 612. The fluid passages 610 are commonly connected to one ink fluid chamber 614 at the backside thereof. The ink is supplied to the ink fluid chamber 614 via an ink supply port 616, and the ink is supplied to the fluid passages 610 from the ink fluid chamber 614.

The heater board 604 is aligned with the top board 606 so that the heaters 602 are disposed at positions corresponding to the fluid passages 610, thereby assembling the heater board 604 and the fluid passages 610 as shown in FIG. 6. Referring to FIG. 6, only two heaters 602 are shown; however, the heaters 602 are disposed in one to one correspondence with the fluid passages 610 thereof. If a predetermined drive pulse is applied to the heaters 602 in the assembled state shown in FIG. 6, film boiling is caused in the ink on the heaters 602 and bubbles are formed. A pressure caused by the bubbles presses out the ink from the discharge ports 608, thereby discharging the ink. In this case, it is possible to control the volume of the ink which is discharged to a certain extent by controlling the drive pulse which is applied to the heaters 602.

Figure 7:
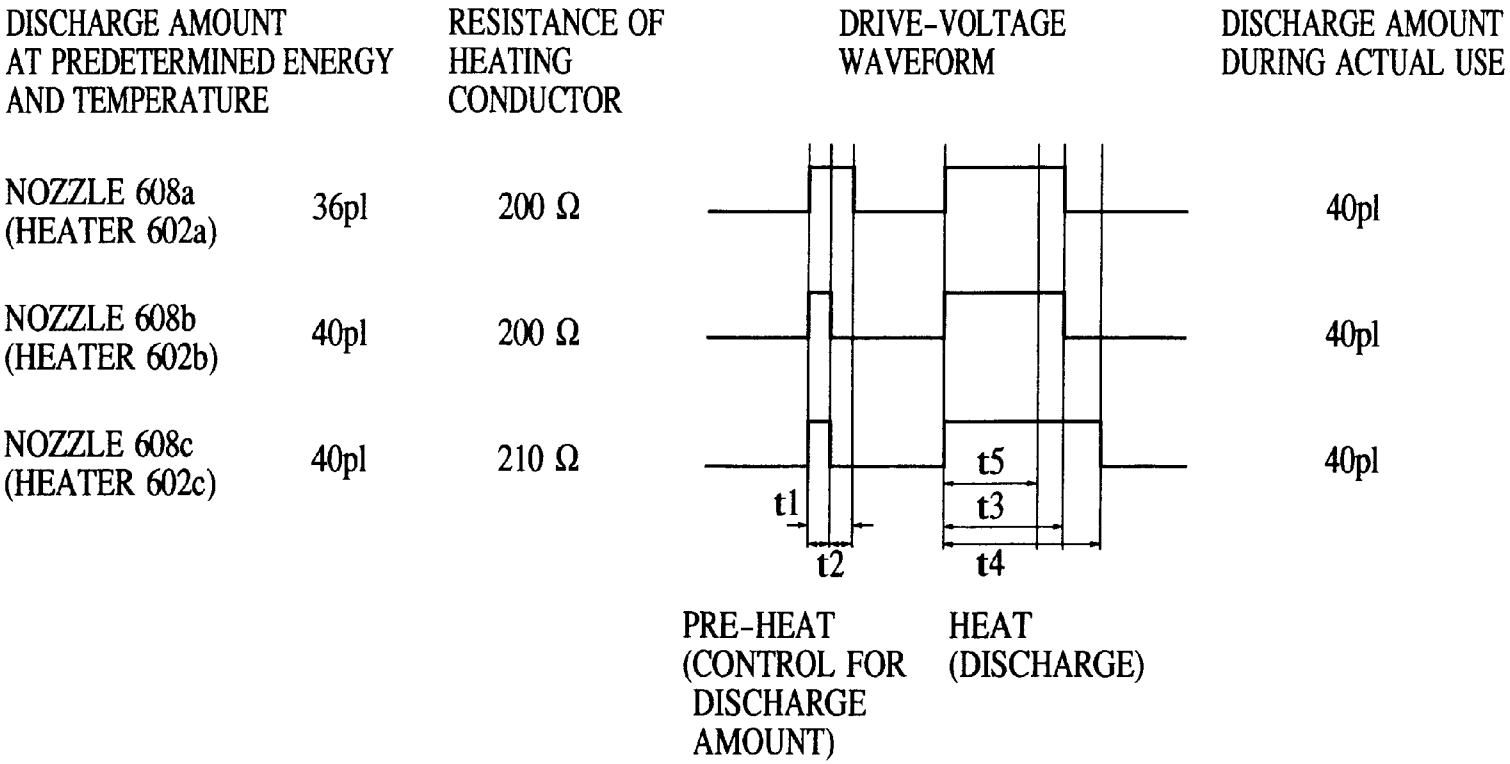
FIG. 7 is a diagram for illustrating a method for controlling the amount of discharged ink by changing an amount of power which is applied to a heater.

FIG. 7 is a diagram for illustrating one method for controlling the amount of discharged ink by changing the drive pulse which is applied to the heaters 102. According to the present embodiment, two kinds of predetermined voltage pulses are applied to the heaters 602 in order to adjust the amount of discharged ink. The two pulses denote a pre-heat pulse and a main-heat pulse (simply referred to as a heat pulse, hereinafter) as shown in FIG. 7. The ink is heated in advance before the ink droplet is actually ejected by the pre-heat pulse and a width in pre-heat pulse is set to a value which is shorter than a width t5 of a pulse that has the lowest value necessary for ejecting ink droplets. Therefore, the ink is not ejected by the pre-heat pulse. Adjusting the width of the pre-heat pulse enables the amount of discharged ink to be adjusted.

To actually eject ink droplets, the width of the heat pulse which is set to the value which is longer than the pulse width t5 that has the lowest value necessary for the ejecting ink droplets. An energy which is generated by the heaters 602 is proportional to a width of the heat pulse and, therefore, variations in characteristics of the heaters 602 can be adjusted by controlling the width of the heat pulse.

It is also possible to control the amount of discharged ink by controlling an interval between the pre-heat pulse and the heat pulse and by controlling a state of the diffusion of heat by the pre-heat pulse.

As understood from the above description, it is possible to control the amount of discharged ink not only by controlling the pulse widths of the pre-heat pulse and the heat pulse but also by controlling the width of the interval between the pre-heat pulse and the heat pulse.

Figure 3:
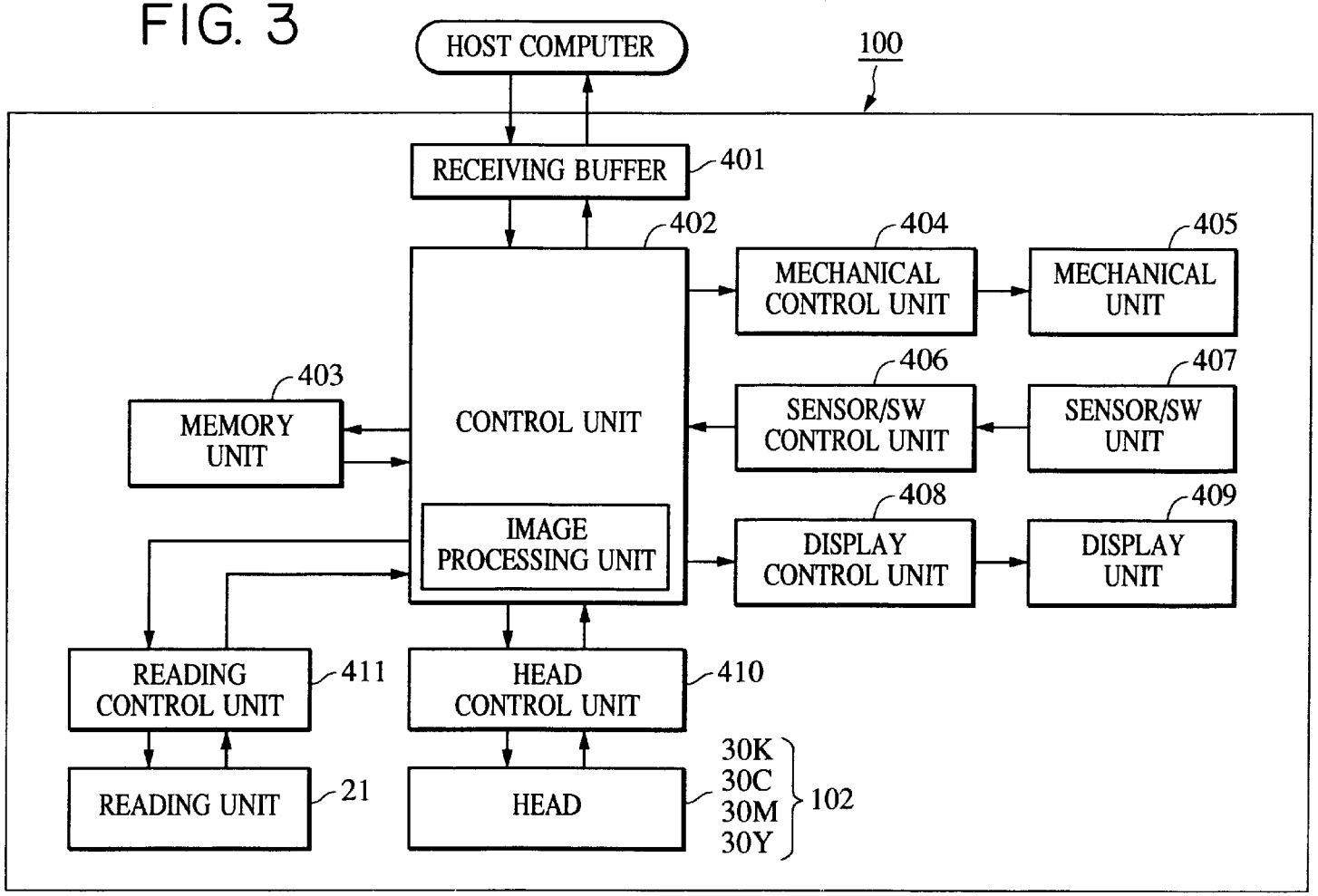
FIG. 3 is a block diagram showing a control construction of the ink-jet recording apparatus according to the first embodiment of the present invention.

FIG. 3 is a block diagram showing a control construction of the ink-jet recording apparatus according to the first embodiment of the present invention. Data of a character and an image which should be printed (abbreviated to image data, hereinafter) is inputted to a receiving buffer 401 in the ink-jet recording apparatus 100 from a host computer. Data for confirming whether or not data is correctly transferred and data for informing the host computer of an operating state of the ink-jet recording apparatus 100 are transferred to the host computer from the ink-jet recording apparatus 100. Under the management of a control unit 402 having a CPU, the data which is inputted to the receiving buffer 401 is transferred to a memory unit 403 serving as a RAM and is temporarily stored thereto. A mechanical control unit 404 drives a mechanical unit 405 such as a carriage motor or a line feed motor which becomes a source of a power of the carriage 101 and the feed roller 109 (shown in FIG. 2) in response to an instruction from the control unit 402. A sensor/switch (SW) control unit 406 transmits a signal from a sensor/switch (SW) unit 407 which comprises various sensors and a switch to the control unit 402. A display control unit 408 controls a display operation of the display unit 409, which comprises LEDs serving as display panels and a liquid display device, etc. in response to the instruction from the control unit 402. A head control unit 410 individually controls each of the heads 30K, 30C, 30M, and 30Y in response to the instruction from the control unit 402, and transmits temperature information indicative of a state of the heads 30K, 30C, 30M, and 30Y to the control unit 402. A reading control unit 411 controls the reading unit 21 in response to the instruction from the control unit 402, and transmits a signal from the reading unit 21 to the control unit 402.

A description is herein given to a method for coping with the deterioration in recorded image, the method being characteristic of the present invention. More particularly, the description is provided as to a method whereby a cause of the deterioration in recorded image is precisely discriminated, the determined result is promptly fed back to the head, and thus, the cause can be efficiently resolved. In other words, the head is managed so that the state of the head is always known and an image having high quality can always be recorded.

As for the recording of an image, it is sufficient to use any one of a binary recording method whereby one pixel is formed by one ink-dot, a multi-drop method for forming one pixel by a plurality of ink dots which are discharged from the same discharge port, and a multi-scanning method for forming one pixel by a plurality of dots which are discharged from different discharge ports. According to the embodiment, the recording is executed by the following method.

Figure 4:
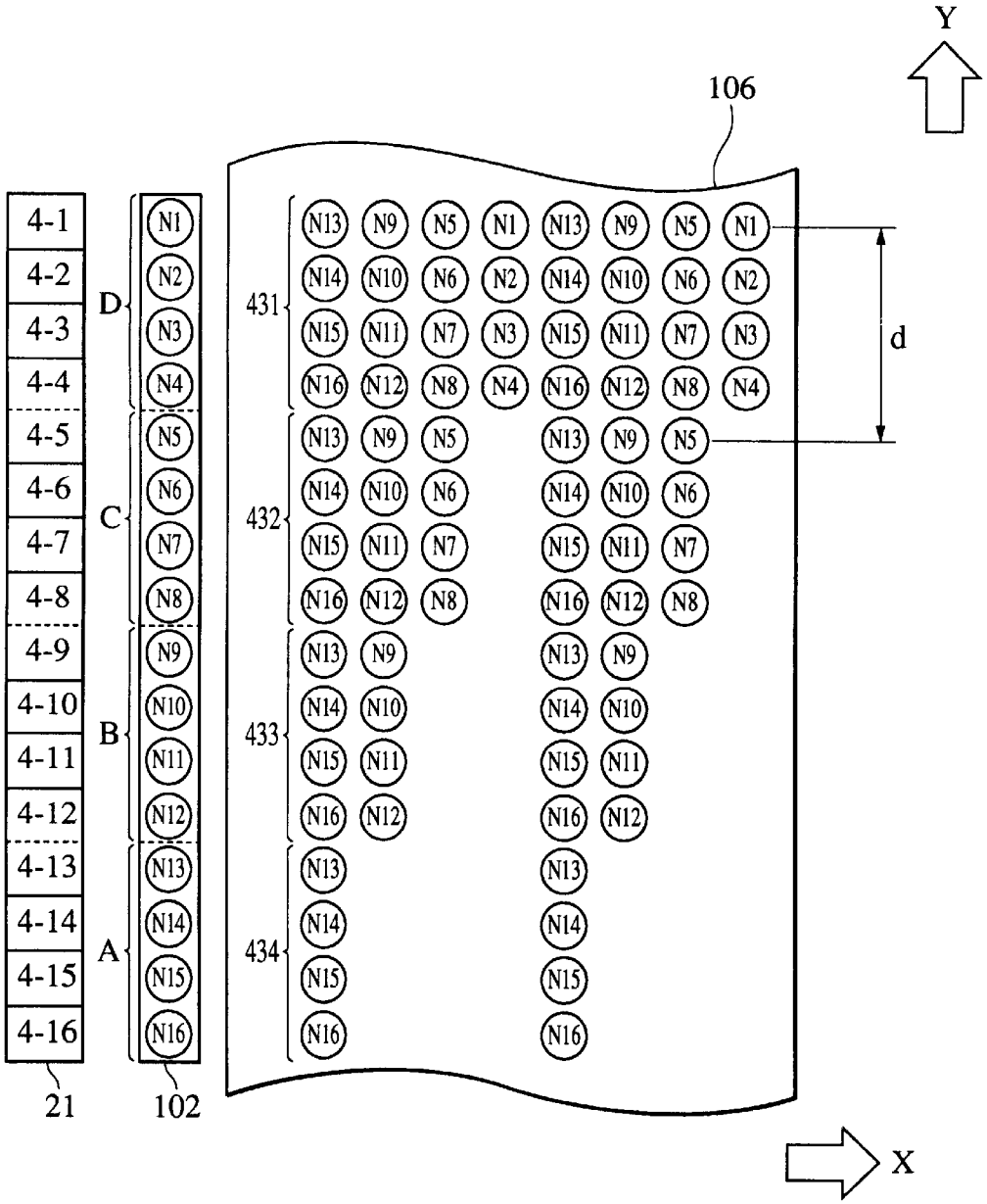
FIG. 4 is a diagram for illustrating one example of imaging of the present invention.

FIG. 4 is a diagram for illustrating one example of imaging according to the present invention and shows that the recording is executed by operating plural main scans across the same area (one dot line) of the recording medium, thereby recording the same area with discharged ink from a plurality of different discharge ports. Referring to FIG. 4, reference numeral 102 schematically denotes a recording head having sixteen nozzles. The sixteen nozzles N1 to N16 are segmented into four nozzle portions (blocks) of an A-portion (N13 to N16), a B-portion (N9 to N12), a C-portion (N5 to N8), and a D-portion (N1 to N4), and the same image area is subjected to four main scans, thereby completing the recorded image.

First, in a first main scan (at the time of forward movement in the X-direction), ink is discharged to a first recording-area 431 from the nozzles N13 to N16 of the recording head 102 in accordance with image data which is to be recorded by the A-portion (N13 to N16) of the recording head 102. When the recording of a first main scan ends, the recording medium 106 is moved by a distance d in a Y-direction and the carriage returns to the home position. Incidentally, the operation for moving the recording medium and carriage is preformed after every end of recording in the main scan.

Next, in a second main scan (at the time of forward movement), ink is discharged to the first recording-area 431 from the nozzles N9 to N12 of the recording head 102 in accordance with image data which is to be recorded by the B-portion (N9 to N12) of the recording head 102. In parallel thereto, the recording by the A-portion (N13 to N16) is executed to a second recording-area 432.

Further, in a third main scan (at the time of forward movement), ink is discharged to the first recording-area 431 from the nozzles N5 to N8 of the recording head 102 in accordance with image data which is to be recorded by the C-portion (N5 to N8) of the recording head 102. In parallel thereto, the recording by the A-portion (N13 to N16) and by the B-portion (N9 to N12) is executed to a third recording-area 433 and the second recording-area 432, respectively.

Furthermore, in a forth main scan (at the time of forward movement), ink is discharged to the first recording-area 431 from the nozzles N1 to N4 of the recording head 102 in accordance with image data which is to be recorded by the D-portion (N1 to N4) of the recording head 102. In parallel thereto, the recording by the A-portion (N13 to N16), the B-portion (N9 to N12), and the C-portion (N5 to N8) is executed to a fourth recording-area 434, the third recording-area 433, and the second recording-area 432, respectively.

Figures 14A, 14B, 14C:
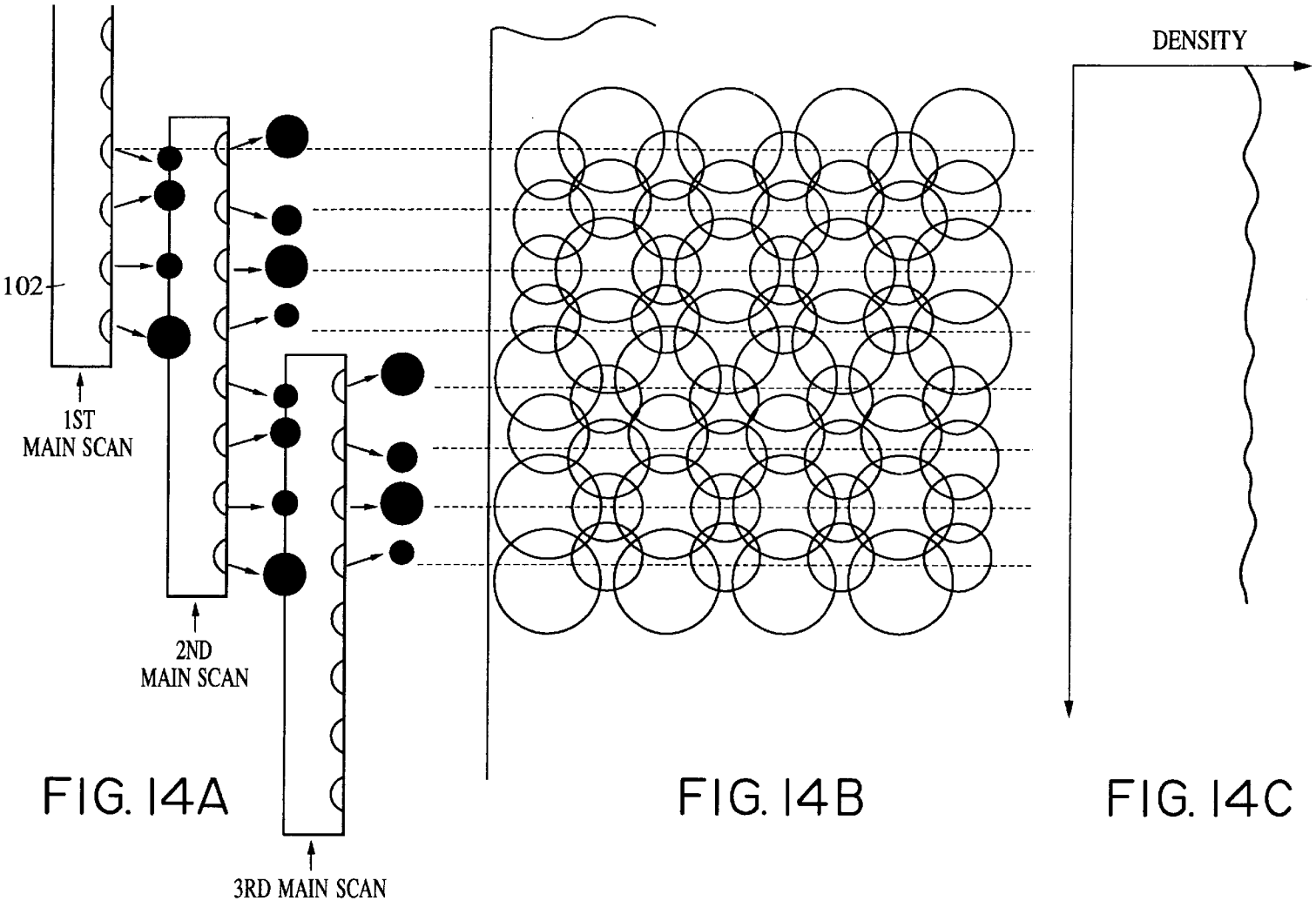
FIGS. 14A to 14C are diagrams showing the case of recording by scanning the same area of a recording medium by the head a plurality of times.
Figure 15C:
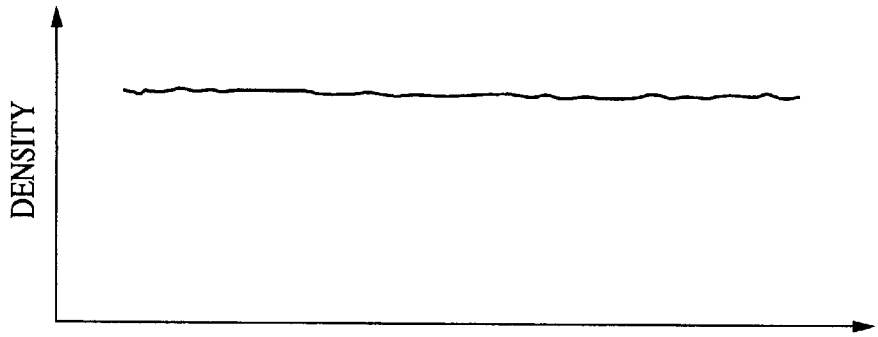
FIGS. 15A to 15C are diagrams showing an ideal printing state of an ink-jet printer.
Figure 15B:
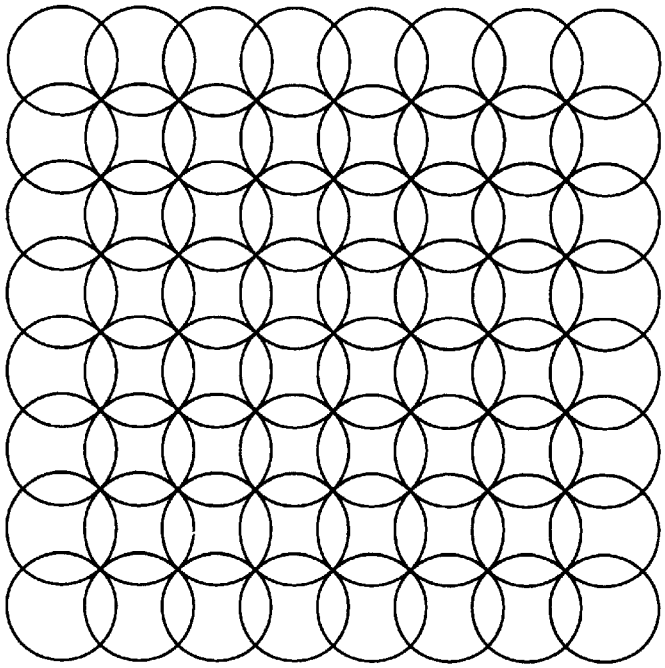
Figure 15A:
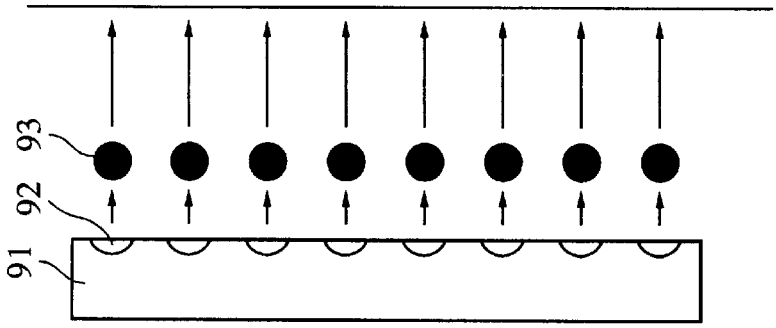
Figure 16C:
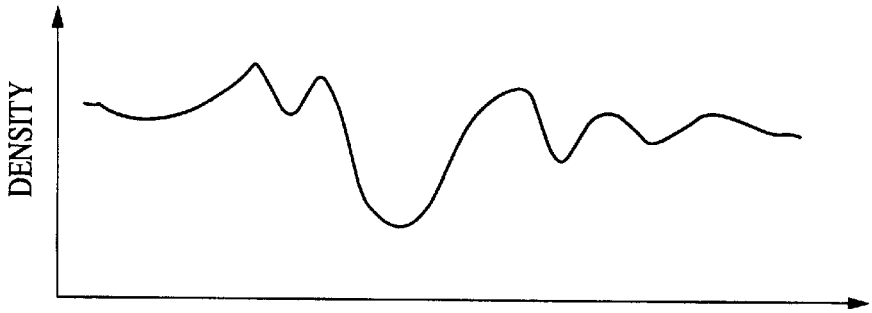
FIGS. 16A to 16C are diagrams showing a printing state of the ink-jet printer in which unevenness of density is present.
Figure 16B:
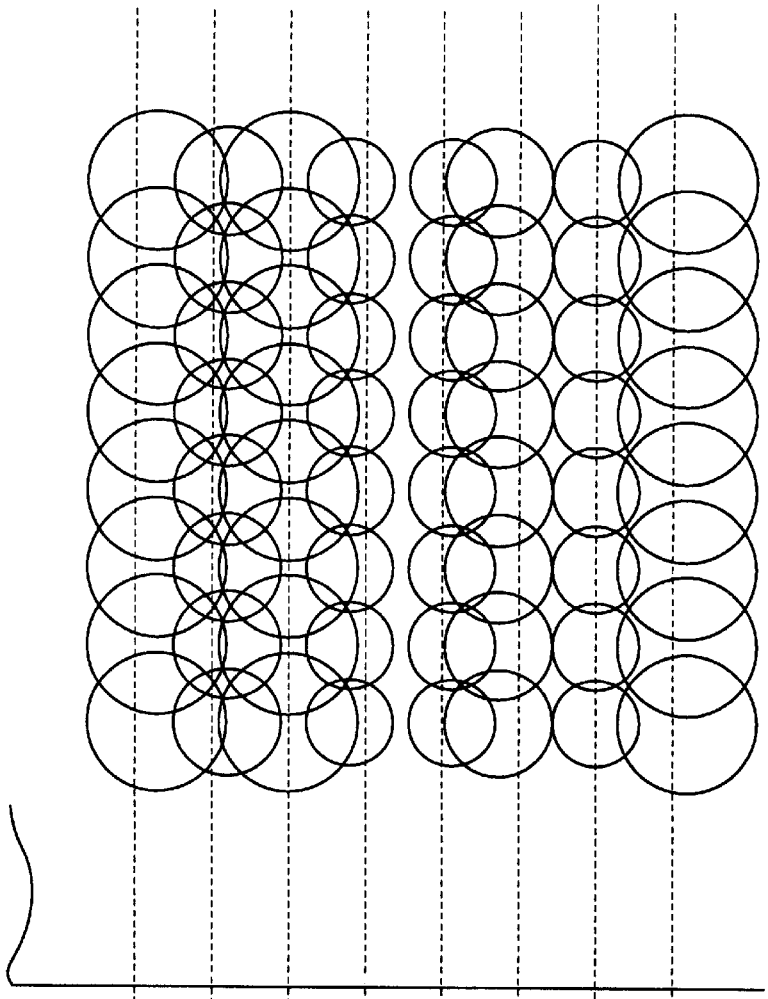
Figure 16A:
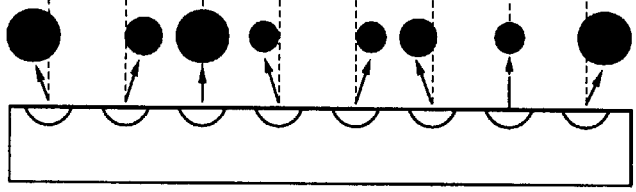

The above-mentioned recording is sequentially repeated, and the recording corresponding to one page ends. The recording process in this mean decreases the unevenness of density decreases as shown in FIGS. 14A to 14C.

Next, a method for reading the recorded image will be described with reference to FIG. 4. Referring to FIG. 4, reference numeral 21 denotes a CCD (optical reading unit) which has sixteen reading elements which are disposed at the same pitch as that of the nozzle of the recording head 102 and scans the image in an X-direction at the same speed as that of the recording head 102 from the backside of the recording head 102. Incidentally, as for a reading timing, it is possible to use any one of a method for reading the image at the time of forward movement (the same scan as the recording) and a method for reading the image at the time of backward movement (a different scan from the recording). In the present embodiment, a case of reading the image by the back scan will be described. All of the recorded image may be read, for example, an image having a high-density portion, a low-density portion, and a medium-density portion may be selected and read. Alternatively, a specific portion of the recording medium, for example, a portion of the start of writing, a portion of the end of writing, and a portion of the center of the image may be selected and read. In the present embodiment, a case of reading the whole of the recording medium will be described. In the present embodiment, it is the image to be read that is actually recorded, not a test pattern that is formed to specify discharge-defective nozzles.

To start with, at the time of backward movement after the first main scan, reading elements 4-13 to 4-16 read dots which are recorded in the first recording-area 431 (dots which are discharged from the nozzles N13 to N16). The read data is stored in the memory unit 403. Thereafter, the recording medium 106 is moved by a distance d in the Y-direction and the second main scan is next performed. Subsequently, the image is similarly read at the time of the backward movement of the main scans.

At the time of the backward movement after the second main scan, reading elements 4-9 to 4-12 read dots which are discharged from the nozzles N9 to N12 in the first recording-area 431. In parallel thereto, the reading elements 4-13 to 4-16 read dots which are discharged from the nozzles N13 to N16 in the second recording-area 432. At the time of backward movement after the third main scan, reading elements 4-5 to 4-8 read dots which are discharged from the nozzles N5 to N8 in the first recording-area 431. In parallel thereto, the reading elements 4-13 to 4-16 also read dots which are discharged from the nozzles N13 to N16 in the third recording-area 433, and the reading elements 4-9 to 4-12 read dots which are discharged from the nozzles N9 to N12 in the second recording-area 432. At the time of backward movement after the fourth main scan, reading elements 4-1 to 4-4 read dots which are discharged from the nozzles N1 to N4 in the first recording-area 431. In parallel thereto, the reading elements 4-13 to 4-16 read dots which are discharged from the nozzles N13 to N16 in the fourth recording-area 434, the reading elements 4-9 to 4-12 read dots which are discharged from the nozzles N9 to N12 in the third recording-area 433, and the reading elements 4-5 to 4-8 read dots which are discharged from the nozzles N5 to N8 in the second recording-area 432. The above reading-operations are sequentially repeated and, then, the reading operation of the image corresponding to the one page ends.

Next, a method for discriminating whether or not the quality of image has deteriorated will be described. This discrimination is performed by comparing the above read data with the image data intended to be recorded. The image data, which indicates the information of the degree of density and the position on the recording medium to be recorded, is labeled as G (image density information). On the other hand, the read data, which indicates the information of the degree of density and the position on the recording medium which have been recorded, is labeled as Y (read density-information). If the recording is ideally executed, G should coincide with Y. However, actually, a difference between G and Y is caused due to variations in the amount of discharged ink and ink discharging direction between discharge ports, or due to the change in amount of discharged ink from one discharge port over time. The difference is defined as S. In other words, an equation of $S=G-Y$ is satisfied. The difference S (difference between the image data intended to be recorded and the read data) is stored in the memory unit 403.

According to the present embodiment, the data which is read in every main scan is compared with the image data, and the difference S as the compared data is stored in the memory unit 403 every main scan. The stored data is used as information for management of the head. The specific method will be described hereinafter.

According to the present embodiment, a cause of the deterioration in quality of the image is specified on the basis of the size of the aforementioned difference S, and the cause is efficiently resolved by selecting the best coping method in accordance with the cause. In order to achieve this, a value of S is always monitored, a state of the head is always known, and, thereby, the head is always in a state in which a normal recording is possible. An image having a high quality can be recorded. A first description is given to a specifying method (discriminating method) of the cause of deterioration of the image quality. Based on two factors, 1) the size of S and 2) the number of discharge-defective nozzles, the cause is discriminated. The size of the difference S is discriminated by the classification of two cases: a case in which S is a large value; and a case in which S is a small value. The size of the difference S is discriminated as a large value when the absolute value of S is equal to or greater than any desired value (first predetermined value) and as a small value when the absolute value of S is smaller than the first predetermined value. The number of discharge-defective nozzles is discriminated by the classification of three cases: a case in which the value of the difference S is caused in only one nozzle, a case in which the value of the difference S is caused in several nozzles, and a case in which the value of the difference S is caused in all nozzles. As mentioned above, by discriminating the two factors, six determined results are obtained. Those are shown in Table 1. As shown in Table 1, all possible combinations of the two factors are denoted as S1 to S6. For instance, if a small value of the difference S is caused in only one nozzle, the case is represented as S1 and if the large value of the difference S is caused in several nozzles, the case is represented as S5.

TABLE 1

| | Small value of S | Large value of S |
|---|---|---|
| One nozzle | S1 | S4 |
| Several nozzles | S2 | S5 |
| All nozzles | S3 (several to all nozzles) | S6 |

A description is given below to the discriminating method of S1 to S6. A description is also given to a determining method of one processing method to be executed among a plurality of processing methods for preventing image deterioration in accordance with the determined result. The processes are controlled by the CPU in the ink-jet recording apparatus.

[Case of Determined Result S1]

Figure 5:
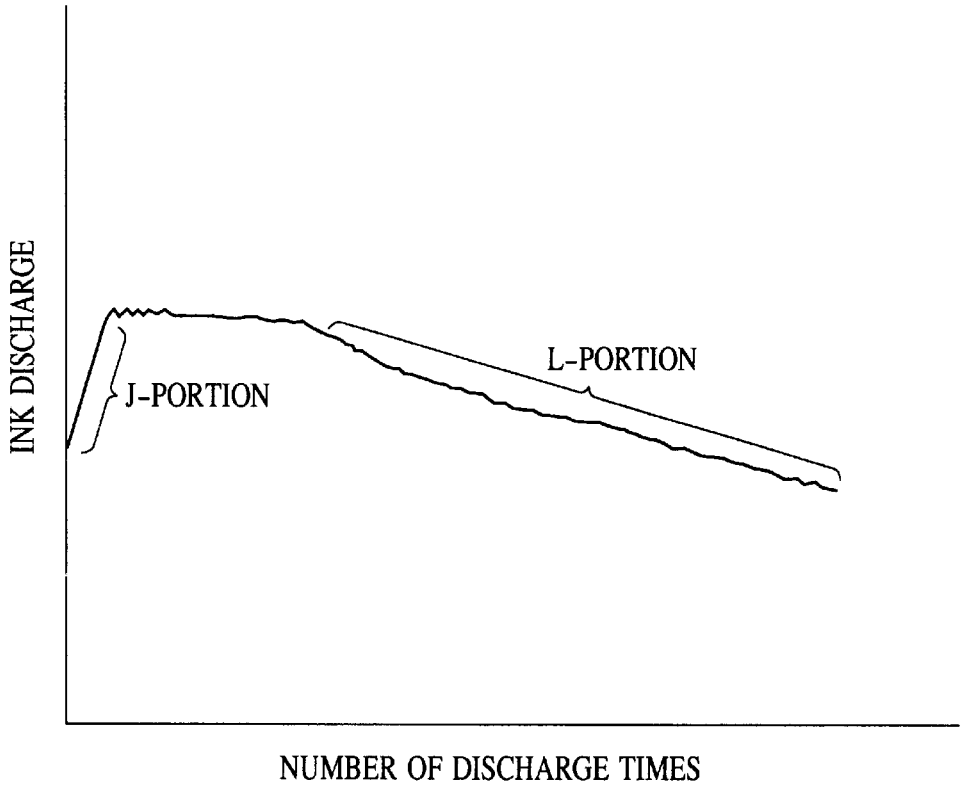
FIG. 5 is a diagram showing a relationship between the number of discharge times and the amount of discharged ink.

Generally, according to the recording head based on the bubble jet (BJ) method, the amount of discharged ink changes as shown in FIG. 5 as the number of discharge times increases in many cases. The amount of discharged ink increases to a certain extent at a J-portion in FIG. 5 by removing fine dirt in a heater unit and components in the ink which are adhered to the heater unit by the ink discharge. This phenomenon is referred to as "aging phenomenon of the heater". The occurrence of aging phenomenon (the increase in amount of discharged ink at the J-portion) creates in problems that the density of the image changes, color is unbalanced, and, further, unevenness is caused when the degrees of aging of discharge nozzles differ. In order to prevent these problems, according to the recording head based on conventional BJ method, an operation to cause the aging phenomenon is sufficiently executed at the factory and the product is shipped to the user after the volume of discharge becomes stable.

According to the present embodiment, it is possible to determine the aging phenomenon as the cause of the increase in density of the image because the state of the recording head is always observed. That is, Y relatively increases as compared to G over time, in other words, it is observed that S decreases over time. When the decrease is observed, it is possible to adjust the density of the image by using the following methods (A) and (B). (A) The information is transmitted to an image processing unit and the number of ink droplet ejections is adjusted. (B) The information is transmitted to the head control unit and the pulse width of a drive pulse which is applied to the recording head is changed and the amount of discharged ink is changed. Although both the methods (A) and (B) can be adopted, generally, the methods (A) and (B) are suitable to coarse adjustment and fine adjustment, respectively. Therefore, the use of either one of method (A) and method (B) or both is selected and the adjustment is implemented in accordance with the size of S. It is also possible to use other method for adjusting the density of ejection of the ink droplets such as a method for adjusting a voltage of the drive pulse.

As shown at an L-portion in FIG. 5, as the number of discharge times further increases and the amount of discharged ink might decrease in accordance with the kogation of the heater unit and the change in state of the orifice, and it is observed that S increases over time. Also if the temperature in the head increases during the main scan and the amount of discharged ink increases, it is observed that S is a small value.

In the ink-jet recording head, fine dusts from the ink fluid passage and a recovering system might be mixed. This causes problems not only using the BJ method but also a piezo ink-jet (PJ) method. Thus, the discharging operation is disordered and this results in a decrease in amount of discharged ink and in a change in discharging direction. In this case, it is observed that S is a small value.

As mentioned above, when it is observed that S is a small value in only one nozzle, this is determined as S1. That is, the change in discharged ink and discharging direction from one discharge port is determined by the fine change in absolute value of S. When the case is determined as S1, preferably, the discharge port is first subjected to the recovering process such as wiping and cleaning. In the case of S1, the change in amount of discharged ink and ink discharging direction is corrected by this recovering process in many cases. When the correction by the recovering process is not sufficient, the amount of discharged ink may be adjusted by use of the method (A) or (B). Thus, the amount of discharged ink can become proper and the unevenness of density in the image can be reduced.

In the case of S1, only the amount of discharged ink may be adjusted by the method (A) or (B), without performing the recovering process. However, this is not preferable because the amount of discharged ink is adjusted against the fine change in amount of discharged ink only from one nozzle and, thereby, the control operation becomes complicated, and the adjustment is necessary for every change in amount of discharged ink, thus requiring a long time. The recovering process is most efficient against the mixture of fine dusts. Therefore, the first execution of the recovering process results in making the control operation simpler and more efficient.

The image density may be adjusted after every observation of S, alternatively, it may be adjusted after determining the increase/decrease in S by using a well-known statistic method such as averaging of data corresponding to one to several sheets of recording paper and analyzing a spectrum of changes.

[Case of Determined Result S2]

With respect to the ink-jet recording head, there is a problem that may be created by the dirt near the discharge port created by ink mist and sheet powder, the mixture of bubbles in the fluid chamber, and the thickening in accordance with the evaporation of ink solvent. This problem might occur not only in the recording head based on the BJ method but also based on the PJ method. Consequently, the operation of discharging ink is disordered, the amount of discharged ink is reduced, and the ink discharging direction is changed. Typically, the phenomenon is caused in a plurality of nozzles.

When it is observed that S is a small value in a plurality of nozzles, this is determined as S2, thus resulting in determining the change due to the above cause.

In the case of S2, the recovering process is first performed similarly to the case of S1. When the correction by the recovering process is not sufficient, the amount of discharged ink is adjusted by the method (A) or (B). Thus, an image having proper density can be recorded.

[Case of Determined Result S3]

With respect to the ink-jet recording head, there is a problem that the amount of discharged ink and the ink discharging direction may vary depending on the discharge port because of an error in the step of producing the head, and then unevenness of density and a streak are caused. In this case, S is a small value in several to all nozzles, thus determining this result S3. In the case of S3, the method (A) or (B) is executed, thus adjusting the amount of discharged ink and ink discharging direction so as to remove the variation thereof in every discharge port.

[Case of Determined S4]

The phenomenon which is determined as one of S1 to S3 is the change in image density which is caused by a relatively small change in amount of discharged ink and ink discharging direction. In the head based on the IJ(ink-jet)-method, there is a problem when the amount of discharged ink substantially changes and the ink discharging direction substantially changes.

For instance, a large dust particle may be mixed in the nozzle from the ink fluid passage or the recovering system. This phenomenon appears not only in the BJ head, but also in the PJ head. Consequently, the discharging operation is disordered, the amount of discharged ink significantly decreases, and the discharging direction also significantly changes. In some circumstances, the ink cannot be discharged at all. In this case, it is observed that S is a large value.

In some circumstances, no bubbles are formed and no ink is discharged. This problem may be caused by short circuit due to corrosion of the power supply line to the nozzles or by short circuit of the heater in the head based on the BJ method by some cause. In this case, it is observed that S is a large value.

A plurality of discharge nozzles are rarely simultaneously clogged with large dust particles and a plurality of power lines and heaters are rarely simultaneously short-circuited. Therefore, when S is a large value in one or a few nozzles, this is determined as clogging due to large dust particles or the short circuit of the heater and also as S4.

In the case of S4, the image data to be normally recorded by the discharge-defective nozzle is instead recorded by another normal nozzle (referred to as complementary recording, hereinafter). For example, when it is determined that S regarding the nozzle N14 is a large value, an image to be recorded normally by the nozzle N14 is recorded by the other nozzles N2, N6, and N10 which scan the same recording area as the recording area which is scanned by the nozzle N14.

Figure 8:
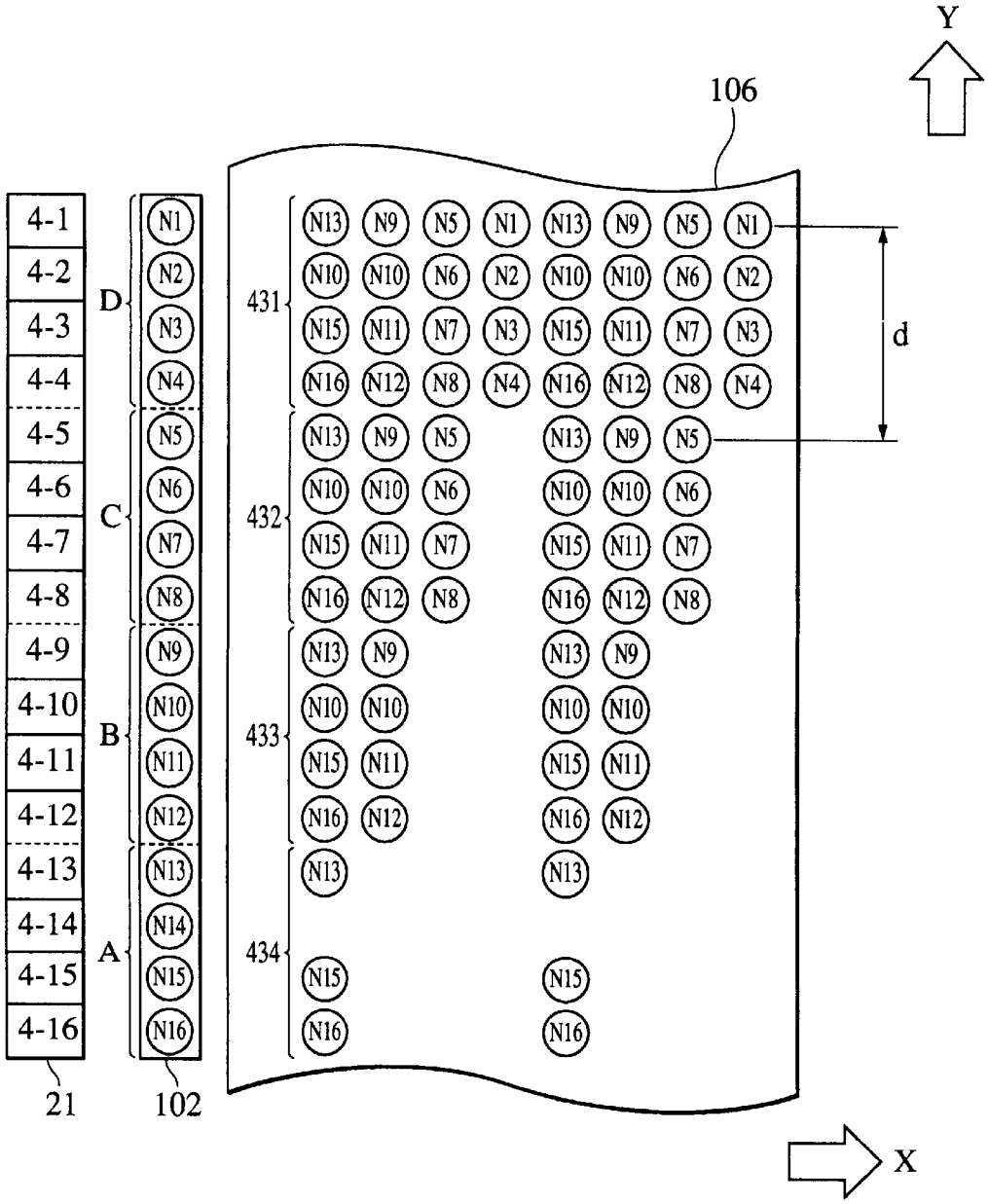
FIG. 8 is a diagram for illustrating a complementing process against non-discharge shown in a first embodiment of the present invention.

This is described with reference to FIG. 8. FIG. 8 shows a state in which the nozzle N14 in the head 102 cannot discharge ink. The fourth recording-area 434 in the recording medium 106 which lacks the dots to be recorded by the nozzle N14 is recorded. The reading element 4-14 in the CCD 21 detects the lack of dots. In parallel thereto, the third recording-area 433 is recorded by the B-portion (N9 to N12) in the recording head 102. The dots to be normally recorded by the nozzle N14 are instead recorded by the nozzle N10. As described above, it is possible to compensate for the lack of dots which is caused by the discharge-defective nozzle.

If a non-discharge nozzle or a discharge-defective nozzle is caused, the portion to be normally recorded by the nozzle can be recorded by another nozzle. Therefore, it is possible to record an image having a high quality without needing to exchange the head, increasing costs, and reducing a recording speed.

[Case of Determined Result S5]

When a large range on an orifice surface gets wet by ink, kogation of on the heater is large, and/or the degree of ink thickening is increased, then, the discharging volume enormously decreases and/or the discharging direction dramatically changes. In this case, it is observed that S is a large value. This case is determined as S5. In this case, S ordinarily increases over time.

In the case of S5, the recovering process is first performed. If the correction by the recovering process is not sufficient, the complementary recording is executed similarly as in FIG. 4. Incidentally, the large change in amount of discharged ink cannot be sufficiently corrected by the method (A) and (B) in many cases. However, if the discharging state is improved by the recovering process to a certain extent and the change can be corrected by the method (A) and (B), the amount of discharged ink may be adjusted by the method (A) and (B).

In the case of S4 or S5, when a preferable image is not obtained by single and/or combining use of the recovering process, complementing process, or adjusting process for the amount of discharged ink, information to the effect that the exchange of the head is required is outputted so as to inform a user to exchange the head. This information can be provided to a user by using a method for displaying specific indication to the printer and a method for displaying a message to a host computer on the side of the user. Further, the head can also be automatically ordered from a manufacturer of the head or a sales shop by using communicating channels such as the Internet or a facsimile machine.

[Case of Determined Result S6]

When it is observed that S is a large value throughout all of the nozzles, this is determined as S6. S6 is caused when there is no ink in the fluid chamber, the ink is absent in the ink tank or the ink is not supplied between the ink tank and the fluid chamber.

In the case of S6, the recovering process is first executed once or a plurality of times. If the state of S6 continues after the recovering process, information regarding the shortage of ink is outputted. Thereafter, the shortage of ink is determined and ink is supplemented. If an ink remaining-amount detecting device is provided, based on the signal of the device and the value of S, it can be determined whether there is no ink in the ink tank or whether the ink is not being supplied between the ink tank and the fluid chamber, and the recovering process can be omitted. However, if the ink remaining-amount detecting device is not provided, the shortage of ink can be detected by repeating the discrimination of S and the recovering process. According to the present invention, it is advantageous in terms of cost not to require ink remaining-amount detecting device.

The ink can be supplemented by using well-known methods, e.g., a method for automatically supplementing ink from a tank for supplementation, a method for displaying specific indication (such as indication of the shortage of ink and indication for promoting the supplementation of ink) to a printer, or a method for displaying a message (message regarding the shortage of ink and the supplementation of ink) to a host computer on the side of a user. Furthermore, a replacement ink tank can also be automatically ordered from a manufacturer or a sales shop by using communicating channels such as the Internet or a facsimile machine.

In the determination of which problem condition exists, the determined result might be different depending on the discharge nozzle. If one nozzle is determined as S2 and other nozzles are determined as S5, the process corresponding to S5 takes priority over the process corresponding to S2 because the process corresponding to S5 results in more effective correction of image deterioration, as compared with the process corresponding to S2.

As mentioned above, the determination of which problem condition exists is performed and, based on the determined result, a processing method to be executed is determined from a plurality of processing methods to prevent image deterioration. A cause by which the quality of image deteriorates is specified on the basis of the two factors of the size of S and the number of discharge-defective nozzles and, thereby, it is possible to precisely determine the cause and to address the problem efficiently. As a result, it is possible to provide an ink-jet recording apparatus capable of avoiding a decrease in throughput and of recording an image having high quality and no unevenness of density without trouble for the user when the discharging operation becomes defective. Since the image which is actually recorded is read and the read result is promptly fed back, it is possible to promptly execute a proper process and to consistently record an image having high quality when some defect occurs in the head.

[Second Embodiment]

According to the first embodiment, if the value of S is small, the case is necessarily determined as one of S1 to S3 and a process corresponding to one of S1 to S3 is performed. However, if the value of S which does not influence the quality of image is determined to be sufficiently small, various processes (recovering process etc.) are unnecessary. According to the present embodiment, a second predetermined value is set in advance and no process is conducted if the absolute value of S is equal to the second predetermined value or less. This makes a useless or inefficient process unnecessary. Time for the process can be reduced and various processes can become more efficient, as compared with that of the first embodiment.

[Third Embodiment]

Figure 9:
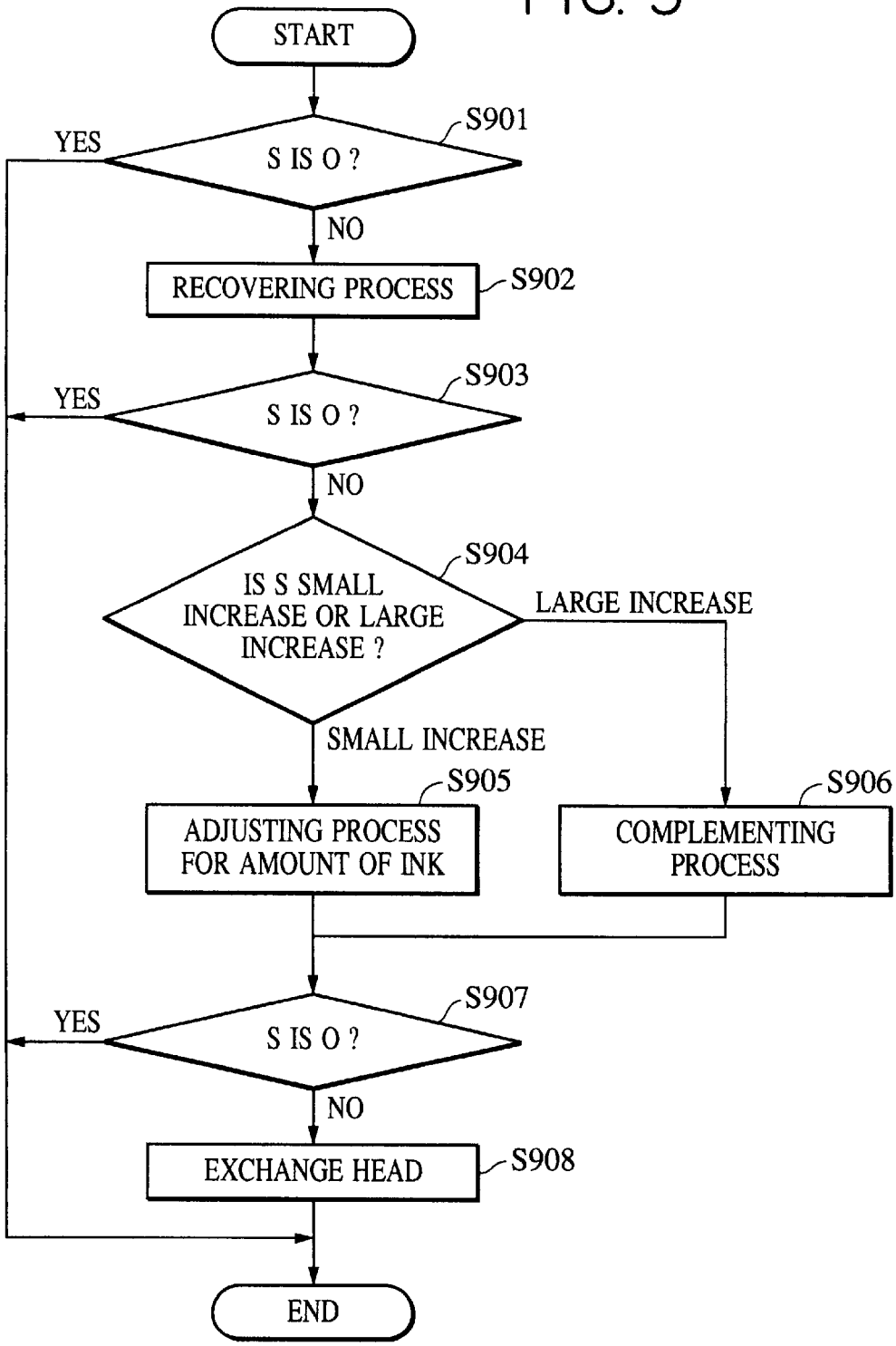
FIG. 9 is a flowchart showing a processing method for a head according to a third embodiment.

A third embodiment will be described with reference to FIG. 9. FIG. 9 is a flowchart showing a processing method for a head according to the present embodiment. A control program on which the process is executed is stored in the memory unit 403.

According to the first and second embodiments, the determination of which problem condition exists is performed and the various processes are executed in accordance with the determined result. However, according to the present embodiment, if it is determined that S is not 0 (step S901), the recovering process is first executed (step S902). Thereafter, it is discriminated whether or not S is 0 (step S903) and, if S is not 0 yet by the recovering process, it is discriminated whether S is small or large (step S904). After that, the following processes are performed.

If the value of S is small, the amount of discharged ink is adjusted by the method (A) and/or (B) (step S905). If the value of S is large, the above-mentioned complementing process is performed (step S906).

After the process is executed, it is discriminated again whether or not S is 0 (step S907). If by performing the process, S is 0, an image having a proper density can be obtained. However, if S is not 0 after executing the process, the head is exchanged (step S908).

Differently from the first and second embodiments, according to the present embodiment, attention is paid only to the size of S and the recovering process is executed once if it is determined that S is not equal to 0. Since S normally becomes equal to 0 after conducting the recovering process, it is efficient to first execute the recovering process if it is determined that S is not 0.

Although the recovering process is performed one time, the number of executing times of the recovering process is not limited to one time. By performing the recovering process two or three times, S might be 0. Therefore, it is preferable to determine the number of executing times of the recovering process in consideration of the above case. In this case, it is possible to use a method for performing the recovering process only the number of executing times which is determined in advance and a method for determining the number of executing times of the recovering process while seeing the tendency of the decrease in S.

Similarly to the second embodiment, a second predetermined value is set and no process may be performed if S is equal to or less than the second predetermined value. Thus, the advantage of the second embodiment can also be effected.

According to the present embodiment, it is possible to implement the recovering process at a proper timing by always knowing S. Thereby, the cause of the defective discharge can be efficiently removed and the deterioration in image quality also can be minimized. Since only the size of S is considered in the present embodiment, the control operation is simpler than those of the first and second embodiments.

[Fourth Embodiment]

Although, the processing method to prevent image deterioration is determined, based on the difference S between the read density-information of the read data and the image density information of the image data, the processing method is not limited to the operation of reading S in order to realize the present invention. Instead, it may be determined which nozzle is the discharge-defective nozzle.

According to the present embodiment, it is determined whether or not the ink is normally ejected from the discharge nozzle. If it is determined that there is a discharge-defective nozzle, various processes are performed on the head similarly to the first to third embodiments. A light-emitting device (LED) and a light receiving device (photo diode) are used and, thereby, non-discharge of the ink droplet is detected, thus detecting the discharge-defective nozzle. According to this method, the recording head is stopped at a predetermined detecting position and ink droplets are ejected through beams which are emitted from the light-emitting device from the nozzle, thereby detecting the non-discharge nozzle, i.e., the discharge-defective nozzle is detected on the basis of the output change in the light receiving device which receives the beams.

Figure 10:
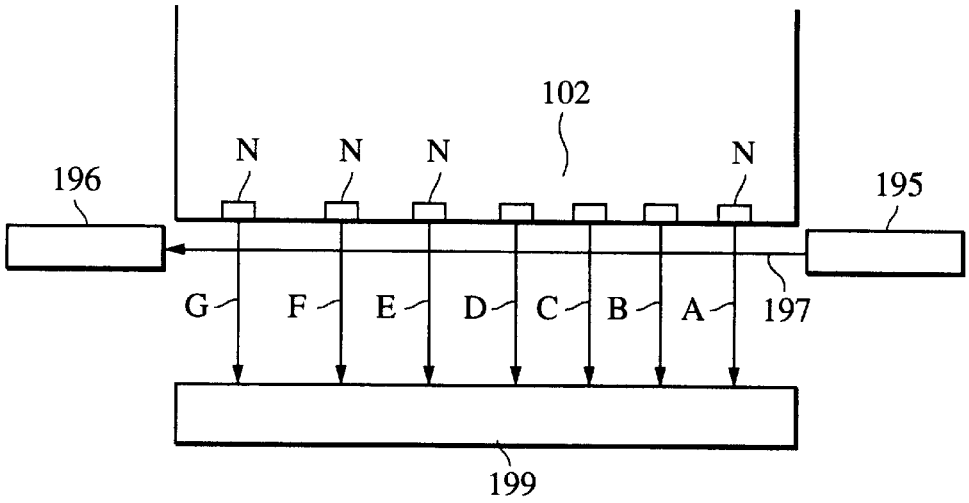
FIG. 10 is a side view showing a principle for detecting a non-discharge nozzle according to a fourth embodiment.
Figure 11:
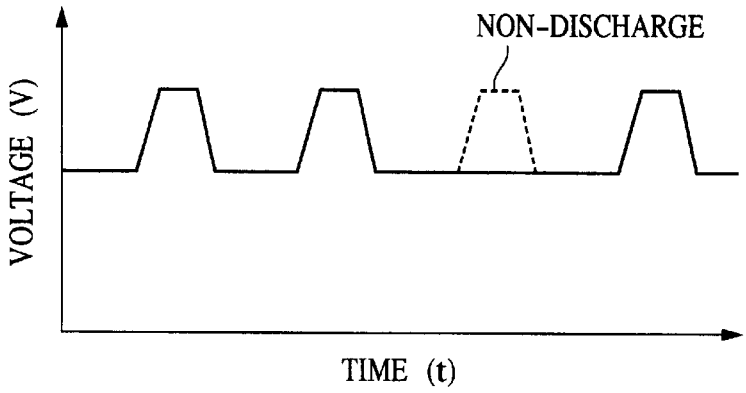
FIG. 11 is a waveform diagram showing a voltage waveform which is detected by a light receiving device when ink droplets are sequentially discharged from a nozzle as a function of time according to the fourth embodiment.

The method for detecting a discharge-defective nozzle will be specifically described with reference to FIGS. 10 and 11. Referring to FIG. 10, reference numeral 197 denotes an arrow which represents a narrow beam (laser beam). Reference numeral 195 denotes a light-emitting device and 196 denotes a light receiving device. Ink droplets are ejected into a clogging preventing device or receptacle 199 from the head 102 while the position of the beam 197 is changed from the position near the light-emitting device 195 to the position near the light receiving device 196. Then, the clogging preventing device 199 receives the discharged ink when the head 102 executes a discharging operation for making the discharge condition even by ink refreshing. The clogging preventing device 199 is provided at a portion facing the head 102 out of the recording area by the head 102. Fluid receiving members for absorbing and receiving ink which are pre-discharged are disposed between a capping device and the printed area and at the position opposite thereto. A fluid holding member (not shown) is provided in the fluid receiving member and made of a porous member such as a sponge.

It is discriminated whether or not a discharge-defective nozzle exists as follows. As shown in FIG. 11, the ordinate denotes the amount of light (indicated as a voltage in this case) which the light receiving device 196 detects and the abscissa denotes time. If there is a position at which the voltage does not change (position at which there is no change in voltage shown by a dotted line in FIG. 11), it is determined that an ink droplet is not discharged. By discriminating whether or not light-amount detecting sensitivity (voltage) having a correlation with a light receiving distance and light diffraction is held to a predetermined level, the discharge-defective nozzle can be detected. In other words, the discharge-defective nozzle is detected in accordance with the magnitude of an output voltage V.

A control unit (such as a CPU) in the system main body for integrally controlling the head 102 executes a control operation for ejecting ink droplets from a nozzle N of the head 102 sequentially in order of time series for any desired predetermined-cycle as shown in FIG. 10 by arrows A, B, C, . . . , G and a control operation for discriminating whether or not the ink droplet is discharged by change in voltage which appears by the detection of change in amount of light by the light receiving device 196 and for specifying the discharge-defective nozzle.

As mentioned above, the discharge operation of the head 102 is controlled and the discharge-defective nozzle is detected on the basis of the change in amount of light by the light receiving device 196. Thus, it is possible to detect the defect with certainty of discharge of all nozzles N.

Figure 12:
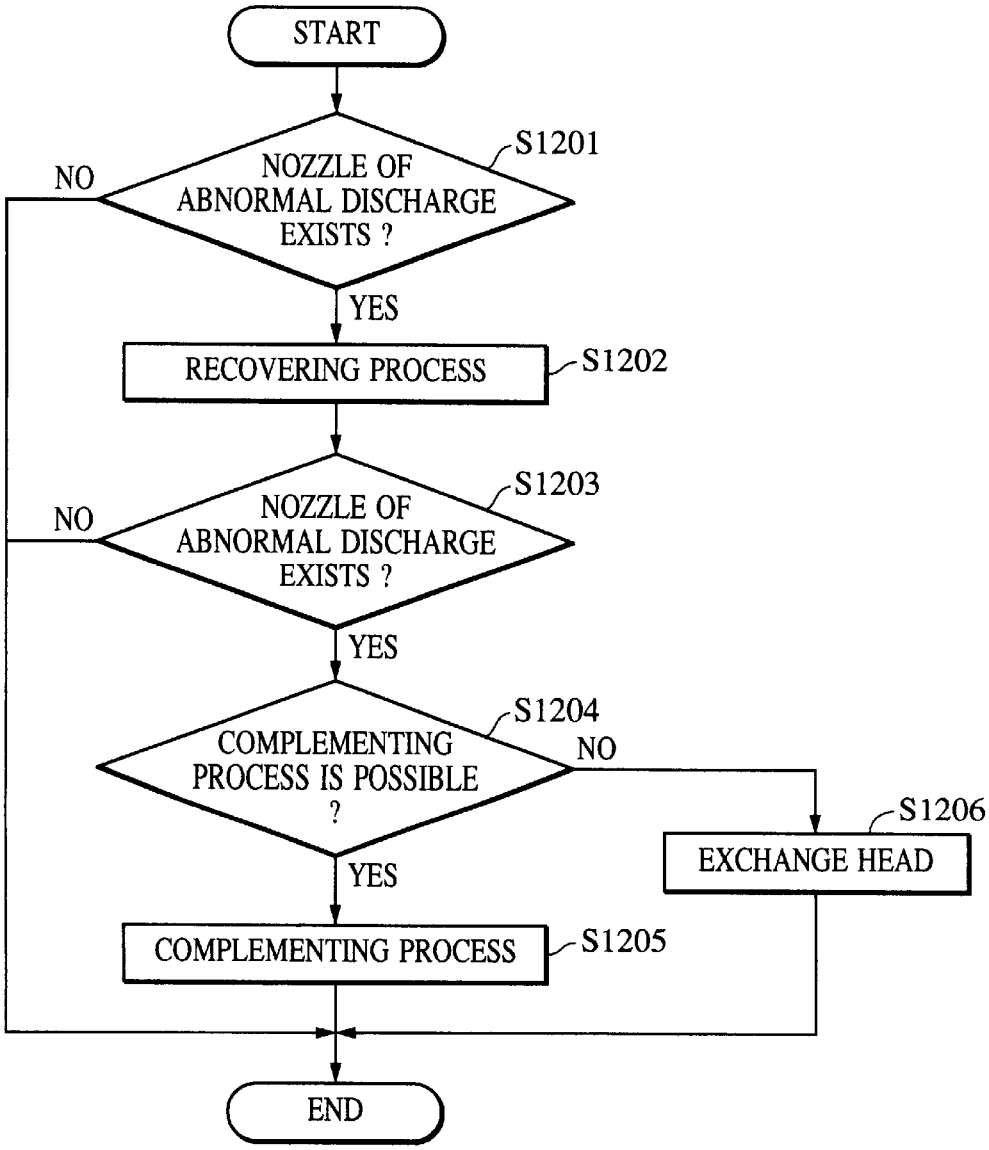
FIG. 12 is a flowchart showing a processing method for the head according to the fourth embodiment.

FIG. 12 is a flowchart showing a processing method for the head according to the present embodiment. A control program which executes the process is stored in the memory 403. First of all, it is determined whether or not there is a discharge-defective nozzle by a detecting method according to the present embodiment in step S1201. If there is a discharge-defective nozzle, the processing routine proceeds to step S1202 whereupon the recovering process is executed. Thereafter, the above-mentioned discharge defective nozzle is detected again in step S1203 and the processing routine proceeds to step S1204. In step S1204, it is discriminated whether or not the complementary recording process shown in the first embodiment is possible. For instance, if there are too many discharge-defective nozzles, the portion to be normally recorded by one discharge-defective nozzle cannot be complementary recorded by another normal nozzle. In this case, it is determined that the complementation recording process is impossible. If it is determined in step S1204 that the complementation recording process is possible, the processing routine proceeds to step S1205 whereupon the complementation recording process is performed. If it is determined in step S1204 that the complementary recording process is impossible, the processing routine proceeds to step S1206 whereupon the head 102 is exchanged. Incidentally, if all nozzles are initially discharge-defective and all nozzles are still discharge-defective after the recovering process, this is determined as the shortage of ink and, preferably, ink is supplemented in the ink tank.

According to the present embodiment, the head is stopped at the predetermined detecting position and it is determined whether or not a discharge-defective nozzle exists. Thus, there is more time spent as compared with the first to third embodiments in which the discharge-defective nozzle is specified without stopping the head at the predetermined position. However, no recording is performed in a state in which the discharge-defective nozzle exists, so that the defect of discharge can be detected with certainty, and further, the coping method can be automatically executed, thereby minimizing the deterioration in image quality.

[Fifth Embodiment]

Although it is detected only whether or not there is a non-discharge nozzle which cannot discharge ink at all according to the fourth embodiment, the case in which the amount of discharged ink decreases by the burning of the heater unit and the mixture of fine dusts is also detected and, in accordance with the detected result, a processing method to be executed is determined according to the present embodiment.

Figure 13:
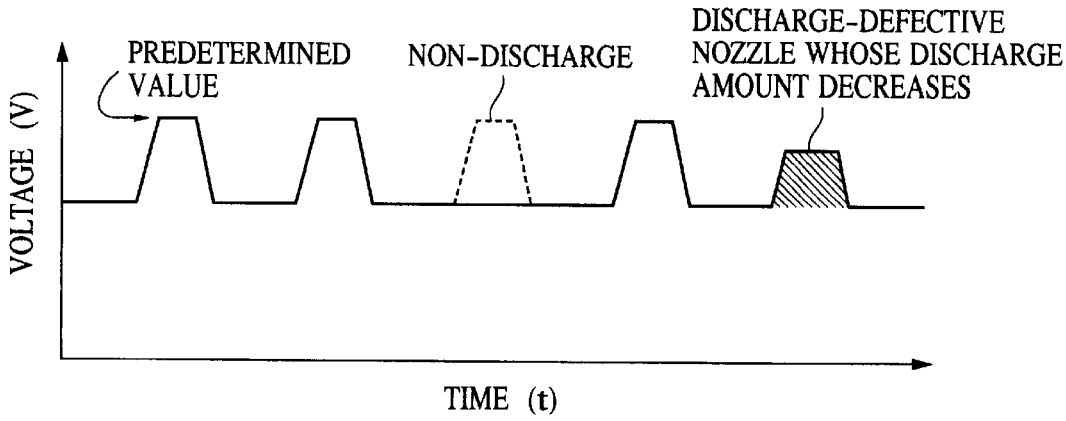
FIG. 13 is a waveform diagram showing a voltage waveform which is detected by a light receiving device when ink droplets are sequentially discharged from the nozzle as a function of time according to a fifth embodiment.

The method for detecting a non-discharge nozzle, a discharge-defective nozzle whose amount of discharged ink decreases, or a normal nozzle is the same as that of the fourth embodiment. That is, according to the present embodiment, as shown in FIG. 13, the ordinate denotes the amount of light (indicated as a voltage in this case) detected by the light receiving device and the abscissa denotes time. If there is a position at which no voltage change occurs (position at which there is no change in voltage shown by a dotted line in FIG. 13), it is determined that the nozzle does not discharge ink at all, and if there is a position at which the voltage does not reach a predetermined value (position shown by the shaded area lines in FIG. 13), it is determined that the nozzle is a discharge-defective nozzle in which the amount of discharged ink decreases. As mentioned above, it is possible to detect the non-discharge nozzle, discharge-defective nozzle, or normal nozzle in accordance with the size of the difference between the value of the output voltage of the nozzle and the predetermined value of the output voltage which is indicated by the normal nozzle.

If it is determined that the nozzle is a non-discharge nozzle as the detected result, the complementary recording process shown in the first embodiment is executed. If it is determined that the nozzle is a discharge-defective nozzle in which the amount of discharged ink decreases, the method for adjusting the amount of discharged ink is conducted by the method (A) and/or (B) shown in the first embodiment.

By discriminating that the nozzle is a non-discharge nozzle or a discharge-defective nozzle in which the amount of the discharged ink droplets decreases, it is possible to implement a more suitable copying method than that of the fourth embodiment.

If it is determined that there is either one of the non-discharge nozzle and the discharge-defective nozzle in which the amount of the discharged ink droplets decreases, the recovering process may be first performed. The nozzles become normal by performing the recovering process in many cases. If the abnormality of the nozzle is resolved only by the recovering process, preferably, this facilitates the control operation more than the executing of the recovering process, the time is not wasted, and the abnormality can be efficiently resolved. As mentioned above, if the recovering process is first executed, the complementary recording process or ink amount adjusting process may be performed only when the abnormality of the nozzle is not resolved yet by the recovering process. In view of the number of non-discharge nozzles and the number of discharge-defective nozzles, it is sufficient to adopt a processing method similar to the processing method to prevent image deterioration shown in the first embodiment.

According to the present embodiment, since there are more types of processing methods for detecting the cause which leads to the abnormality in detail and preventing image deterioration than that of the fourth embodiment, the control operation becomes more complicated than that of the fourth embodiment. However, a more proper processing method can be adopted on the basis of the cause of the abnormality and the deterioration in image quality can be more efficiently reduced, as compared with those of the fourth embodiment.

The processing methods in the first to fifth embodiments may be controlled by the CPU in the ink-jet recording apparatus or may be accomplished by supplying a storage medium in which a program code of software for realizing the functions of the embodiments in a computer which is connected to the ink-jet recording apparatus and by reading out and executing the program code which is stored in the storage medium by the computer. When the computer reads out and the executes the program code which is stored in the storage medium, the program code itself which is read out from the storage medium realizes the functions of the embodiments and, thereby, the storage medium in which the program code is stored is included as the present invention. As the storage medium for supplying the program code, it is possible to use a floppy disk, a hard disk, an optical disk, a magneto-optical disk, a CD-ROM, a CD-R, a magnetic tape, a non-volatile memory card, and a ROM, etc.

According to the above description, the present invention is applied to the print apparatus of the system, among various ink-jet recording systems, which has means (e.g., an electricity-to-heat converter or laser light) for generating heat energy as energy used to discharge ink, and changes the state of ink by using the heat energy. According to this system, a high-density, high-precision recording operation can be realized.

As for the typical structure and principle, it is preferable that the basic structure disclosed in, for example, U.S. Pat. No. 4,723,129 or 4,740,796 is employed. The aforementioned method can be adapted to both a so-called on-demand type apparatus and a continuous type apparatus. In particular, a satisfactory effect can be obtained when the on-demand type apparatus is employed because of the structure arranged in such a manner that one or more drive signals, which rapidly raise the temperature of an electricity-to-heat converter disposed to face a sheet or a fluid passage which holds the fluid (ink) to a level higher than levels at which film boiling takes place are applied to the electricity-to-heat converter in accordance with recording information so as to generate heat energy in the electricity-to-heat converter and to cause the heat effecting surface of the recording head to cause film boiling so that bubbles can be formed in the fluid (ink) to correspond to the one or more drive signals. The enlargement/contraction of the bubble will cause the fluid (ink) to be discharged through a discharging opening so that one or more droplets are formed. If a pulse-shaped drive signal is employed, the bubble can be enlarged/contracted immediately and properly, causing a further preferred effect to be obtained because the fluid (ink) can be discharged while revealing excellent response.

It is preferable that a pulse drive signal disclosed in U.S. Pat. No. 4,463,359 or 4,345,262 is employed. If conditions disclosed in U.S. Pat. No. 4,313,124 which is an invention relating to the temperature rising ratio at the heat effecting surface are employed, a satisfactory recording result can be obtained.

As an alternative to the structure (linear fluid passage or perpendicular fluid passage) of the recording head disclosed in each of the aforementioned inventions and having an arrangement that discharge ports, fluid passages and electricity-to-heat converters are combined, a structure having an arrangement that the heat effecting surface is disposed in a bent region as disclosed in U.S. Pat. No. 4,558,333 or 4,459,600 may be employed. In addition, the following structures may be employed: a structure having an arrangement that a common slit is formed to serve as a discharge section of a plurality of electricity-to-heat converters as disclosed in Japanese Patent Laid-Open No. 59-123670; and a structure disclosed in Japanese Patent Laid-Open No. 59-138461 in which an opening for absorbing pressure waves of heat energy is disposed to correspond to the discharge section.

Furthermore, as a recording head of the full line type having a length corresponding to the maximum width of a recording medium which can be recorded by the recording unit, either the construction which satisfies its length by a combination of a plurality of recording heads as disclosed in the above specifications or the construction as a single full line-type recording head which has integrally been formed can be used.

In addition, the invention is effective for a recording head of the freely exchangeable chip-type which enables electrical connection to the recording unit main body or supply of ink from the main device by being mounted onto the apparatus main body. The invention is also effective for a recording head of the cartridge-type provided integrally on the recording head itself.

It is preferred to additionally employ the recording head restoring means and the auxiliary means provided as the component of the present invention because the effect of the present invention can be further stabilized. Specifically, it is preferable to employ recording head capping means, cleaning means, pressurizing or suction means, electricity-to-heat converter, another heating element or sub-heating means constituted by combining them, and a sub-emitting mode in which ink emitting is performed independently from the recording emitting in order to stably perform the recording operation.

Although a fluid ink is employed in the aforementioned embodiment of the present invention, ink which is solidified at room temperature or lower and softened at the room temperature, ink in the form of a fluid at the room temperature, or ink which is formed into a fluid when the recording signal is supplied may be employed because the aforementioned ink-jet method is ordinarily arranged in such a manner that the temperature of ink is controlled in a range from 30° C. or higher to 70° C. or lower so as to make the viscosity of the ink to be in a stable discharge range.

Furthermore, ink which is solidified when it is caused to stand and liquified when heat energy is supplied in accordance with a recording signal can be adopted by the present invention to positively prevent a temperature rise caused by heat energy by utilizing the temperature rise as energy of state transition from the solid state to the liquid state or to prevent ink evaporation. In any case, ink which is liquified when heat energy is supplied in accordance with a recording signal so as to be discharged in the form of fluid ink, or ink which is liquified only after heat energy is supplied, e.g., ink which starts to solidify when it reaches a recording medium, can be adopted by the present invention. In the aforementioned case, the ink may be of a type which is held as fluid or solid material in a recess of a porous sheet or a through hole at a position to face the electricity-to-heat converter as disclosed in Japanese Patent Laid-Open No. 54-56847 or Japanese Patent Laid-Open No. 60-71260. It is the most preferred way for the ink to be adapted to the aforementioned film boiling method.

According to the present invention, the recording system can grasp a state of the head in a real-time manner and can automatically manage the head. Accordingly, the user can easily obtain an image which is always beautiful without specific difficulty.

The present invention is not limited to the above embodiments and various changes and modifications can be made within the spirit and scope of the present invention. Therefore, to apprise the public of the scope of the present invention, the following claims are made.

What is claimed is:

1. An ink-jet recording apparatus for recording an image by scanning a recording head having a plurality of ink discharge nozzles across a recording medium, said apparatus comprising:

a reading unit for reading a recorded image recorded on the recording medium;

a discriminating unit for discriminating whether or not a discharge-defective nozzle exists by detecting a differential level of density information between read density information read by said reading unit and image density information intended to be recorded;

a comparing unit for comparing the differential level of density information with a predetermined density level; and a determining unit for determining, when said discriminating unit discriminates that a discharge-defective nozzle exists, a processing method to be executed, from a plurality of processing methods including a processing method of modifying a recording signal, to reduce image deterioration due to the discharge-defective nozzle based upon whether or not the differential level of density information is equal to or greater than the predetermined density level.

2. An apparatus according to claim 1, wherein when the differential level of density information is equal to or greater than the predetermined density level, a complementary recording process for substituting a normal nozzle for the discharge-defective nozzle to record a portion which normally would be recorded by the discharge-defective nozzle is executed, and when the differential level of density information is less than the predetermined density level, an ink discharge amount adjusting process for adjusting an amount of discharged ink from the discharge-defective nozzle is executed.

3. An apparatus according to claim 2, wherein when the differential level of density information is discriminated, a recovering process for recovering a state of ink discharge is first executed, regardless of a magnitude of the differential level of density information.

4. An apparatus according to claim 2, wherein the ink discharge amount adjusting process comprises adjusting an amount of discharged ink by increasing or decreasing a number of ejections from at least one nozzle.

5. An apparatus according to claim 2, wherein the ink discharge amount adjusting process comprises adjusting an amount of discharged ink by shortening or lengthening pulses applied for ink ejection.

6. An apparatus according to claim 1, wherein said recording head includes a heat energy generating unit for applying heat to ink, the applied heat being sufficient to generate bubbles for displacing and discharging the ink.

7. An apparatus according to claim 1, wherein the processing method of modifying the recording signal includes at least one of a complementary recording processing method for substituting a normal nozzle for the discharge-defective nozzle to record a portion which normally would be recorded by the discharge-defective nozzle, and an ink discharge amount adjusting processing method for adjusting an amount of discharged ink from the discharge-defective nozzle.

8. An ink-jet recording apparatus for recording an image by scanning a recording head having a plurality of ink discharge nozzles across a recording medium, said apparatus comprising:

a reading unit for reading a recorded image recorded on the recording medium;

a first discriminating unit for discriminating whether or not each nozzle is a discharge-defective nozzle by detecting a difference of density information between read density information read by said reading unit and image density information intended to be recorded by a corresponding nozzle;

a second discriminating unit for discriminating whether or not the difference of density information is equal to or greater than a first predetermined density level;

a third discriminating unit for discriminating a number of nozzles in which the difference of density information is detected and into which numerical range, of at least two numerical ranges, the discriminated number falls; and a determining unit for determining, when said first discriminating unit discriminates that one or more discharge-defective nozzles exists, a processing method to be executed from a plurality of processing methods to reduce image deterioration due to the one or more discharge-defective nozzles based upon results determined by said second discriminating unit and the numerical range discriminated by said third discriminating unit.

9. An apparatus according to claim 8, wherein when said first discriminating unit discriminates that at least one nozzle is a discharge-defective nozzle and said second discriminating unit discriminates that the difference in density information for a nozzle is equal to or greater than the first predetermined density level and said third discriminating unit discriminates that the number of nozzles in which the difference in density information is detected is equal to one, a complementary recording process for substituting a normal nozzle for the discharge-defective nozzle to record a portion which normally would be recorded by the discharge-defective nozzle is executed.

10. An apparatus according to claim 8, wherein when said second discriminating unit discriminates that the difference of density information for at least one nozzle is equal to or greater than the first predetermined density level and said third discriminating unit discriminates that the number of nozzles in which the difference in density information is detected is greater than one but less than a total number of nozzles included in the recording head, a recovering process for recovering a state of ink discharge is first executed and, when said first discriminating unit discriminates that at least one nozzle remains a discharge-defective nozzle after the recovering process is executed, a complementary recording process for substituting a normal nozzle for the at least one discharge-defective nozzle to record a portion which normally would be recorded by the at least one discharge-defective nozzle is executed.

11. An apparatus according to claim 10, wherein when said first discriminating unit discriminates that at least one nozzle remains a discharge-defective nozzle and said second discriminating unit discriminates that the difference of density information for at least one nozzle remains equal to or greater than the first predetermined density level after the recovering process and the complementary recording process are executed, an ink discharge amount adjusting process for adjusting an amount of discharged ink from the at least one discharge-defective nozzle is executed.

12. An apparatus according to claim 11, wherein when said second discriminating unit discriminates that the difference of density information remains equal to or greater than the first predetermined density level after the ink discharge amount adjusting process is executed, information regarding a necessity to replace the recording head or add ink is outputted.

13. An apparatus according to claim 8, wherein when said second discriminating unit discriminates that the difference of density information for at least one nozzle is equal to or greater than the first predetermined density level and said third discriminating unit discriminates that the number of nozzles in which the difference in density information is detected is equal to the total number of nozzles included in the recording head, information regarding a shortage of ink is outputted.

14. An apparatus according to claim 13, wherein the information regarding a shortage of ink is outputted via a display.

15. An apparatus according to claim 13, wherein the information regarding a shortage of ink is outputted via transmission to one or a plurality of computers via a host computer or a network which is connected to the ink-jet recording apparatus.

16. An apparatus according to claim 8, wherein when said first discriminating unit discriminates that at least one nozzle is a discharge-defective nozzle, said second discriminating unit discriminates that the difference of density information is less than the first predetermined density level and said third discriminating unit discriminates that the number of nozzles in which the difference in density information is detected is equal to or greater than a predetermined number of nozzles, an ink discharge amount adjusting process for adjusting an amount of discharged ink from the at least one discharge-defective nozzle is executed.

17. An apparatus according to claim 16, wherein the ink discharge amount adjusting process comprises adjusting an amount of discharged ink by increasing or decreasing a number of ejections from at least one nozzle.

18. An apparatus according to claim 16, wherein said ink discharge amount adjusting process comprises adjusting an amount of discharged ink by shortening or lengthening pulses applied for ink ejection.

19. An apparatus according to claim 8, wherein when said second discriminating unit discriminates that said difference of density information is less than the first predetermined density level and said third discriminating unit discriminates that the number of nozzles in which said difference in density information is detected is less than a predetermined number of nozzles, a recovering process for recovering a state of ink discharge is first executed and, when said first discriminating unit discriminates that at least one nozzle remains a discharge-defective nozzle, an ink discharge amount adjusting process for adjusting an amount of discharged ink from the at least one discharge-defective nozzle is executed.

20. An apparatus according to claim 19, wherein the ink discharge amount adjusting process comprises adjusting an amount of discharged ink by increasing or decreasing a number of ejections from the at least one discharge-defective nozzle.

21. An apparatus according to claim 19, wherein the ink discharge amount adjusting process comprises adjusting an amount of discharged ink by shortening or lengthening pulses applied for ink ejection.

22. An apparatus according to claim 8, wherein a second predetermined density level which is less than the first predetermined density level is set and, when the difference of density information is less than or equal to the second predetermined density level, no process is executed.

23. An apparatus according to claim 8, wherein at least one pixel of the recorded image is formed by ink discharged from a plurality of discharge ports.

24. An apparatus according to claim 8, wherein said third discriminating unit discriminates into which of three numerical ranges the discriminated number falls.

25. An ink-jet recording apparatus for recording an image by scanning a recording head having a plurality of ink discharge nozzles across a recording medium, said apparatus comprising:

a discriminating unit for discriminating whether or not each nozzle is a discharge-defective nozzle; and a determining unit for determining, when said discriminating unit discriminates that a discharge-defective nozzle exists, a processing method to be executed, from a plurality of processing methods, to reduce image deterioration due to the discharge-defective nozzle based upon whether or not a differential level between information which is indicated by a normal nozzle and information which is indicated by the discharge-defective nozzle is equal to or greater than a predetermined level, wherein the plurality of processing methods include a complementary recording processing method for substituting a normal nozzle for the discharge-defective nozzle to record a portion which normally would be recorded by the discharge-defective nozzle, an ink discharge amount adjusting processing method for adjusting an amount of discharged ink from the discharge-defective nozzle, and a recording recovering processing method for recovering a state of ink discharge.

26. An apparatus according to claim 25, wherein when said discriminating unit discriminates that at least one discharge-defective nozzle exists, the recording recovering processing method for recovering the state of ink discharge is first executed, regardless of a magnitude of the differential level.

27. An ink-jet recording method for recording an image by scanning a recording head having a plurality of ink discharge nozzles across a recording medium, said method comprising the steps of:

reading a recorded image recorded on the recording medium;

discriminating whether or not a discharge-defective nozzle exists by detecting a differential level of density information between read density information read in said reading step and image density information intended to be recorded;

comparing the differential level of density information with a predetermined density level; and determining, when discriminated in said discriminating step that a discharge-defective nozzle exists, a processing method to be executed, from a plurality of processing methods including a processing method of modifying a recording signal, to reduce image deterioration due to the discharge-defective nozzle based upon whether or not the differential level of density information is equal to or greater than the predetermined density level.

28. A method according to claim 27, wherein the processing method of modifying the recording signal includes at least one of a complementary recording processing method for substituting a normal nozzle for the discharge-defective nozzle to record a portion which normally would be recorded by the discharge-defective nozzle, and an ink discharge amount adjusting processing method for adjusting an amount of discharged ink from the discharge-defective nozzle.

29. An ink-jet recording method for recording an image by scanning a recording head having a plurality of ink discharge nozzles across a recording medium, said method comprising the steps of:

reading a recorded image recorded on the recording medium;

discriminating in a first discriminating step whether or not each nozzle is a discharge-defective nozzle by detecting a difference of density information between read density information read in said reading step and image density information intended to be recorded by a corresponding nozzle;

discriminating in a second discriminating step whether or not the difference of density information is equal to or greater than a first predetermined density level;

discriminating in a third discriminating step a number of nozzles in which the difference of density information is detected and into which numerical range, of at least two numerical ranges, the discriminated number falls; and determining, when discriminated in said first discriminating step that one or more discharge-defective nozzles exists, a processing method to be executed from a plurality of processing methods to reduce image deterioration due to the one or more discharge-defective nozzles based upon results determined in said second discriminating step and the numerical range determined in said third discriminating step.

30. A method according to claim 29, wherein said third discriminating step discriminates into which of three numerical ranges the discriminated number falls.

31. An ink-jet recording method for recording an image by scanning a recording head having a plurality of ink discharge nozzles across a recording medium, said method comprising the steps of:

discriminating whether or not each nozzle is a discharge-defective nozzle; and determining, when discriminated in said discriminating step that a discharge-defective nozzle exists, a processing method to be executed, from a plurality of processing methods, to reduce image deterioration due to the discharge-defective nozzle based upon whether or not a differential level between information which is indicated by a normal nozzle and information which is indicated by the discharge-defective nozzle is equal to or greater than a predetermined level, wherein the plurality of processing methods include a complementary recording processing method for substituting a normal nozzle for the discharge-defective nozzle to record a portion which normally would be recorded by the discharge-defective nozzle, an ink discharge amount adjusting processing method for adjusting an amount of discharged ink from the discharge-defective nozzle, and a recording recovering processing method for recovering a state of ink discharge.

32. An ink-jet recording apparatus for recording an image by scanning a recording head having a plurality of ink discharge nozzles across a recording medium, said apparatus comprising:

a reading unit for reading a recorded image recorded on the recording medium;

a first discriminating unit for discriminating whether or not each nozzle is a discharge-defective nozzle by detecting a difference of density information between read density information read by said reading unit and image density information intended to be recorded by a corresponding nozzle;

a second discriminating unit for discriminating whether or not the difference of density information is equal to or greater than a first predetermined density level;

a third discriminating unit for discriminating a number of nozzles in which the difference of density information is detected; and a determining unit for determining, when said first discriminating unit discriminates that one or more discharge-defective nozzles exists, a processing method to be executed from a plurality of processing methods, including a processing method of modifying a recording signal, to reduce image deterioration due to the one or more discharge-defective nozzles based upon results determined by said second discriminating unit and said third discriminating unit.

33. An ink-jet recording method for recording an image by scanning a recording head having a plurality of ink discharge nozzles across a recording medium, said method comprising the steps of:

reading a recorded image recorded on the recording medium;

discriminating in a first discriminating step whether or not each nozzle is a discharge-defective nozzle by detecting a difference of density information between read density information read in said reading step and image density information intended to be recorded by a corresponding nozzle;

discriminating in a second discriminating step whether or not the difference of density information is equal to or greater than a first predetermined density level;

discriminating in a third discriminating step a number of nozzles in which the difference of density information is detected; and determining, when discriminated in said first discriminating step that one or more discharge-defective nozzles exists, a processing method to be executed from a plurality of processing methods, including a processing method of modifying a recording signal, to reduce image deterioration due to the one or more discharge-defective nozzles based upon results determined in said second discriminating step and said third discriminating step.

* * * * *

UNITED STATES PATENT AND TRADEMARK OFFICE

CERTIFICATE OF CORRECTION

PATENT NO. : 6,652,056 B2
DATED : November 25, 2003
INVENTOR(S) : Shioya

It is certified that error appears in the above-identified patent and that said Letters Patent is hereby corrected as shown below:

Column 3,
Line 41, “the coping” should read -- coping --.

Column 5,
Line 7, “a” should be deleted.
Line 17, “equal or more to” should read -- equal to or more than --.
Line 29, “the” should be deleted.

Column 7,
Line 61, “as a” should read -- a --.

Column 8,
Line 7, “these through.” should read -- through these. --.

Column 15,
Line 24, “of on” should read -- on --.

Column 20,
Line 39, “and the” should read -- and then --.

Signed and Sealed this

Twenty-seventh Day of July, 2004

JON W. DUDAS
*Acting Director of the United States Patent and Trademark Office*